US011268347B2

(12) United States Patent
Olguin et al.

(10) Patent No.: US 11,268,347 B2
(45) Date of Patent: Mar. 8, 2022

(54) TESTABLE SLIDING SLEEVE VALVE

(71) Applicant: National Oilwell Vareo, L.P., Houston, TX (US)

(72) Inventors: Fernando Olguin, Houston, TX (US); Aju Abraham, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 16/633,337

(22) PCT Filed: Jul. 24, 2018

(86) PCT No.: PCT/US2018/043494
§ 371 (c)(1),
(2) Date: Jan. 23, 2020

(87) PCT Pub. No.: WO2019/023235
PCT Pub. Date: Jan. 31, 2019

(65) Prior Publication Data

US 2020/0157917 A1 May 21, 2020

Related U.S. Application Data

(60) Provisional application No. 62/550,243, filed on Aug. 25, 2017, provisional application No. 62/536,105, filed on Jul. 24, 2017.

(51) Int. Cl.
*E21B 34/10* (2006.01)
*E21B 34/14* (2006.01)
(Continued)

(52) U.S. Cl.
CPC ..... *E21B 34/14* (2013.01); *E21B 23/006* (2013.01); *E21B 34/063* (2013.01); *E21B 34/102* (2013.01);
(Continued)

(58) Field of Classification Search
CPC ..... E21B 34/063; E21B 34/10; E21B 34/14; E21B 34/16
(Continued)

(56) References Cited

U.S. PATENT DOCUMENTS 3,665,955 A * 5/1972 Conner, Sr. ..... E21B 34/16 137/495
5,207,272 A 5/1993 Pringle et al.
(Continued)

OTHER PUBLICATIONS

International Search Report and Written Opinion dated Oct. 23, 2019, for Application No. PCT/US2018/043494.

*Primary Examiner* — Kenneth L Thompson
(74) *Attorney, Agent, or Firm* — Conley Rose, P.C.

(57) ABSTRACT

A sliding sleeve valve for use in a borehole includes an outer housing including a radial housing slot, a sliding sleeve slidably disposed in the outer housing, the sliding sleeve including a radial sleeve slot and configured to have a first position that restricts fluid communication between the sleeve slot and the housing slot and a second position, spaced from the first position, that permits fluid communication between the sleeve slot and the housing slot, an actuator housing coupled to the outer housing, wherein the actuator housing includes an actuator chamber defined by an inner surface, and wherein the actuator chamber is disposed between an inner surface and an outer surface of the actuator housing, and an actuator assembly disposed in the actuator chamber, wherein the actuator assembly is configured to control movement of the sliding sleeve between the first and second positions.

34 Claims, 29 Drawing Sheets

(51) Int. Cl.

| | |
|---|---|
| ***E21B 23/00*** | (2006.01) |
| *E21B 34/06* | (2006.01) |
| *E21B 34/12* | (2006.01) |
| *E21B 43/26* | (2006.01) |

(52) U.S. Cl.
CPC ..... *E21B 34/12* (2013.01); *E21B 43/26* (2013.01); *E21B 2200/04* (2020.05); *E21B 2200/06* (2020.05)

(58) Field of Classification Search
USPC ..... 166/331
See application file for complete search history.

(56) References Cited

U.S. PATENT DOCUMENTS

| | | | | |
|---|---|---|---|---|
| 5,597,016 | A * | 1/1997 | Manke | E21B 23/006 138/42 |
| 7,363,980 | B2 * | 4/2008 | Pringle | E21B 34/10 166/319 |
| 7,730,953 | B2 * | 6/2010 | Casciaro | E21B 23/006 166/321 |
| 8,931,565 | B2 * | 1/2015 | Desranleau | E21B 34/14 166/373 |
| 9,683,434 | B2 * | 6/2017 | Machocki | E21B 21/103 |
| 9,816,350 | B2 * | 11/2017 | Mailand | E21B 34/125 |
| 10,156,124 | B2 * | 12/2018 | Guzman | E21B 34/10 |
| 2001/0054504 | A1 | 12/2001 | Carmody et al. | |
| 2009/0206290 | A1 | 8/2009 | Wygnanski | |
| 2011/0278017 | A1 | 11/2011 | Themig et al. | |
| 2012/0279723 | A1 | 11/2012 | Hofman et al. | |
| 2015/0041148 | A1 | 2/2015 | Greenan | |
| 2015/0191995 | A1 | 7/2015 | Vick, Jr. | |
| 2016/0265310 | A1 | 9/2016 | Getzlaf et al. | |
| 2020/0248531 | A1 * | 8/2020 | Walton | E21B 47/12 |

* cited by examiner

TESTABLE SLIDING SLEEVE VALVE

CROSS-REFERENCE TO RELATED APPLICATIONS

This application is a 35 U.S.C. § 371 national stage application of PCT/US2018/043494 filed Jul. 24, 2018, and entitled "Testable Sliding Sleeve Valve," which claims benefit of U.S. provisional patent application Ser. No. 62/536,105 filed Jul. 24, 2017, and entitled "Testable Sliding Sleeve Valve," and U.S. provisional patent application Ser. No. 62/550,243 filed Aug. 25, 2017, and entitled "Testable Sliding Sleeve Valve," each of which is hereby incorporated herein by reference in its entirety.

STATEMENT REGARDING FEDERALLY SPONSORED RESEARCH OR DEVELOPMENT

Not applicable.

BACKGROUND

In drilling a borehole into an earthen formation, such as for the recovery of hydrocarbons or minerals from a subsurface formation, it is typical practice to connect a drill bit onto the lower end of a drillstring formed from a plurality of pipe joints connected end-to-end, and then rotate the drillstring so that the drill bit progresses downward into the earth to create a borehole along a predetermined trajectory. In some applications, the borehole may be drilled in a plurality of stages, where, following the drilling of each stage, a casing or production liner joint is installed within the drilled borehole, and cement is pumped in the annulus formed between the outer surface of the casing joint and the inner surface of the borehole. After the pumped cement has hardened, the inner surface of the section of cased borehole is isolated from fluids disposed within a central passage of the borehole. Additionally, in some applications, each subsequently installed casing or liner joint may be physically supported or anchored from the precedingly installed casing or liner joint, forming a casing or liner string in the borehole.

In at least some applications, when the final stage of the borehole is drilled, a final casing or liner joint is installed at a terminal end of the borehole, and the annulus surrounding the final casing or liner joint, as well as the terminal end of the borehole, is cemented to thereby isolate or seal the inner surface of the borehole from fluid disposed in the central passage thereof. In applications comprising a horizontal or deviated borehole, the terminal end of the borehole may be referred to as the "toe" of the borehole. In certain applications, once the drilled borehole has been successfully cased and cemented, the formation may be hydraulically fractured to provide for controlled fluid communication between the formation and the central passage of the borehole. For instance, the casing or liner string may include a number sliding sleeve valves (e.g., actuated by the dropping of various sized balls into the borehole) for providing selective fluid communication between the formation and the central passage of the casing or liner string. In other applications, the casing or liner string may be perforated at predetermined positions along its axial length (e.g., as part of a "plug and perf" operation) to provide fluid communication between the formation and the central passage of the casing or liner string. Additionally, in some applications, the casing or liner string may include a valve disposed near the terminal end or toe of the borehole for initiating the hydraulic fracturing process.

BRIEF SUMMARY OF THE DISCLOSURE

An embodiment of a sliding sleeve valve for use in a borehole comprises an outer housing comprising a radial housing slot, a sliding sleeve slidably disposed in the outer housing, the sliding sleeve comprising a radial sleeve slot and configured to have a first position that restricts fluid communication between the sleeve slot and the housing slot and a second position, axially spaced from the first position, that permits fluid communication between the sleeve slot and the housing slot, an actuator housing coupled to the outer housing, wherein the actuator housing comprises an actuator chamber defined by an inner surface extending around a central axis of the actuator chamber, and wherein the actuator chamber is disposed radially between an inner cylindrical surface and an outer cylindrical surface of the actuator housing, and an actuator assembly disposed in the actuator chamber, wherein the actuator assembly is configured to control movement of the sliding sleeve between the first and second positions. In some embodiments, an indexing sleeve including a J-slot formed on an outer surface thereof, and an indexing pin coupled to the actuator housing, wherein an inner end of the indexing pin is received in the J-slot of the indexing sleeve. In some embodiments, the actuator assembly is configured to cycle the indexing pin between a plurality of positions along the J-slot of the indexing sleeve in response to pressurizing a central passage of the outer housing. In certain embodiments, the sliding sleeve is maintained in the first position as the indexing pin is cycled between the plurality of positions along the J-slot of the indexing sleeve. In certain embodiments, the actuator assembly comprises a poppet valve assembly. In some embodiments, the actuator chamber is radially offset from a central axis of the actuator housing. In some embodiments, a diameter of the actuation chamber is less than a diameter of a central passage of the actuator housing, wherein the central passage is defined by the inner surface of the actuator housing. In certain embodiments, the sliding sleeve valve further comprises a rupture disk disposed in the inner surface of the actuator housing, wherein the rupture disk is configured to rupture at a predetermined pressure to provide fluid communication between a central passage of the actuator housing and the actuator chamber. In certain embodiments, the sliding sleeve valve further comprises a mandrel disposed in and coupled with the outer housing, the mandrel comprising a cylindrical outer surface, an annular first atmospheric chamber extending between an annular outer housing seal that is disposed radially between the outer housing and the mandrel, and a first sleeve seal that is disposed radially between the sleeve and the outer housing, and an annular second atmospheric chamber extending between a second sleeve seal that is disposed radially between the sleeve and the outer housing, and an actuator seal that is disposed radially between the actuator housing and the mandrel. In some embodiments, the sliding sleeve valve further comprises an actuation passage extending between the actuation chamber and the second atmospheric chamber, wherein the actuator assembly is configured to selectively permit fluid communication between the actuation chamber and the actuation passage. In some embodiments, in response to fluid communication between the actuation chamber and the actuation passage, the actuation assembly is configured to displace the sliding sleeve from the first position to the second position. In certain embodiments, the sliding sleeve valve further comprises a piston housing comprising a central passage that is disposed in the actuator chamber, a piston slidably disposed in the actuator chamber and configured to selectably seal against an inner surface of the passage of the piston housing, an indexing sleeve including a J-slot formed on an outer surface thereof, wherein the indexing sleeve comprises a central passage configured to receive the piston, and an indexing pin coupled to the actuator housing, wherein an inner end of the indexing pin is received in the J-slot of the indexing sleeve. In certain embodiments, an end of the piston is received in the passage of the piston housing when the sliding sleeve is in the first position, and the end of the piston is spaced from the passage of the piston housing when the sliding sleeve is in the second position. In some embodiments, the sliding sleeve valve further comprises a plurality of circumferentially spaced detents positioned radially between the piston and the indexing sleeve, wherein the detents are configured to restrict relative axial movement between the piston and the indexing sleeve when the indexing sleeve is in a first axial position relative to the piston housing, wherein the detents are configured to permit relative axial movement between the piston and the indexing sleeve when the indexing sleeve is in a second axial position relative to the piston housing that is spaced from the first axial position.

An embodiment of a sliding sleeve valve for use in a borehole comprises an outer housing comprising a radial housing slot, a sliding sleeve slidably disposed in the outer housing, the sliding sleeve comprising a radial sleeve slot and configured to have a first position that restricts fluid communication between the sleeve slot and the housing slot and a second position, axially spaced from the first position, that permits fluid communication between the sleeve slot and the housing slot, an actuator housing coupled to the outer housing, wherein the actuator housing comprises a cylindrical actuator chamber that is radially offset from the central axis of the actuator housing, and an actuator assembly disposed in the actuator chamber, wherein the actuator assembly is configured to control the movement of the sliding sleeve between the first and second positions. In certain embodiments, the sliding sleeve valve further comprises a piston housing comprising a central passage that is disposed in the actuator chamber, a piston slidably disposed in the actuator chamber and configured to selectably seal against an inner surface of the passage of the piston housing, a rupture disk configured to provide fluid communication between a central passage of the actuator housing and the actuator chamber in response to the application of a predetermined pressure to a central passage of the actuator housing. In certain embodiments, an end of the piston is received in the passage of the piston housing when the sliding sleeve is in the first position, and the end of the piston is spaced from the passage of the piston housing when the sliding sleeve is in the second position. In some embodiments, the sliding sleeve valve further comprises an indexing sleeve including a J-slot formed on an outer surface thereof, wherein the indexing sleeve comprises a central passage configured to receive the piston, and an indexing pin coupled to the actuator housing, wherein an inner end of the indexing pin is received in the J-slot of the indexing sleeve. In some embodiments, the sliding sleeve valve further comprises a plurality of circumferentially spaced detents positioned radially between the piston and the indexing sleeve, wherein the detents are configured to restrict relative axial movement between the piston and the indexing sleeve when the indexing sleeve is in a first axial position relative to the piston housing, wherein the detents are configured to permit relative axial movement between the piston and the indexing sleeve when the indexing sleeve is in a second axial position relative to the piston housing that is spaced from the first axial position. In certain embodiments, wherein the actuator assembly is configured to cycle the indexing pin between a plurality of positions along the J-slot of the indexing sleeve in response to pressurizing a central passage of the outer housing. In certain embodiments, the sliding sleeve valve further comprises a valve stem disposed in the actuator chamber and configured to selectably seal against a valve seat on a first end of the actuator chamber, a rupture disk configured to provide fluid communication between a central passage of the actuator housing and the actuator chamber in response to the application of a predetermined pressure to a central passage of the actuator housing, a piston disposed about the valve stem, an indexing sleeve including a J-slot formed on an outer surface thereof, wherein the indexing sleeve is disposed about and locked to the piston whereby axial movement of the indexing sleeve relative to the indexing pin is prevented, and an indexing pin coupled to the actuator housing, wherein an inner end of the indexing pin is received in the J-slot of the indexing sleeve. In some embodiments, the sliding sleeve valve further comprises a first biasing member extending between the first end of the actuator chamber and a first end of the piston, wherein the first biasing member is configured to bias the piston and the valve stem towards a second end of the actuation chamber, a second biasing member extending between the first end of the piston and a shoulder on the valve stem, wherein the second biasing member is configured to bias the valve stem towards the valve seat. In some embodiments, in response to rupturing of the rupture disk, the piston is configured to displace the indexing pin from a first position in the J-slot to a second position in the J-slot that is circumferentially and radially spaced from the first position. In some embodiments, in response to displacement of the indexing pin through the J-slot, the indexing pin is configured to release the valve stem from the valve seat and thereby permit fluid communication between the actuation chamber and an actuation passage that extends from the valve seat. In certain embodiments, the actuator chamber is disposed radially between an inner cylindrical surface and an outer cylindrical surface of the actuator housing.

An embodiment of a method for actuating a sliding sleeve valve disposed in a wellbore comprises applying a predetermined pressure to an actuator housing of the sliding sleeve valve wherein the actuator housing comprises a cylindrical actuator chamber that is radially offset from the central axis of the actuator housing, communicating the pressure to an actuator chamber formed in the actuator housing, and moving a sliding sleeve of the sliding sleeve valve from a first position to a second position axially spaced from the first position to provide fluid communication between the sliding sleeve valve and an environment surrounding the sliding sleeve valve in response to communicating the pressure to the actuator chamber. In some embodiments, the method further comprises rupturing a rupture disk of the sliding sleeve valve to communicate the pressure to the actuator chamber. In some embodiments, the method further comprises displacing an indexing sleeve and a piston through the actuator chamber in response to rupturing the rupture disk. In certain embodiments, the method further comprises displacing an indexing pin through a J-slot formed on an outer surface of the indexing sleeve in response to the displacement of the indexing sleeve through the actuator chamber. In certain embodiments, the method further comprises cycling the indexing pin between a plurality of positions along the J-slot of the indexing sleeve in response to pressurizing the actuator housing. In some embodiments, the method further comprises unseating a valve stem disposed in the actuator chamber from a valve seat formed on the actuator chamber to thereby communicate pressure from a central passage of the actuator housing to an atmospheric chamber disposed adjacent to the sliding sleeve.

BRIEF DESCRIPTION OF THE DRAWINGS

For a detailed description of disclosed exemplary embodiments, reference will now be made to the accompanying drawings in which.

DETAILED DESCRIPTION OF DISCLOSED EXEMPLARY EMBODIMENTS

Figure 1:
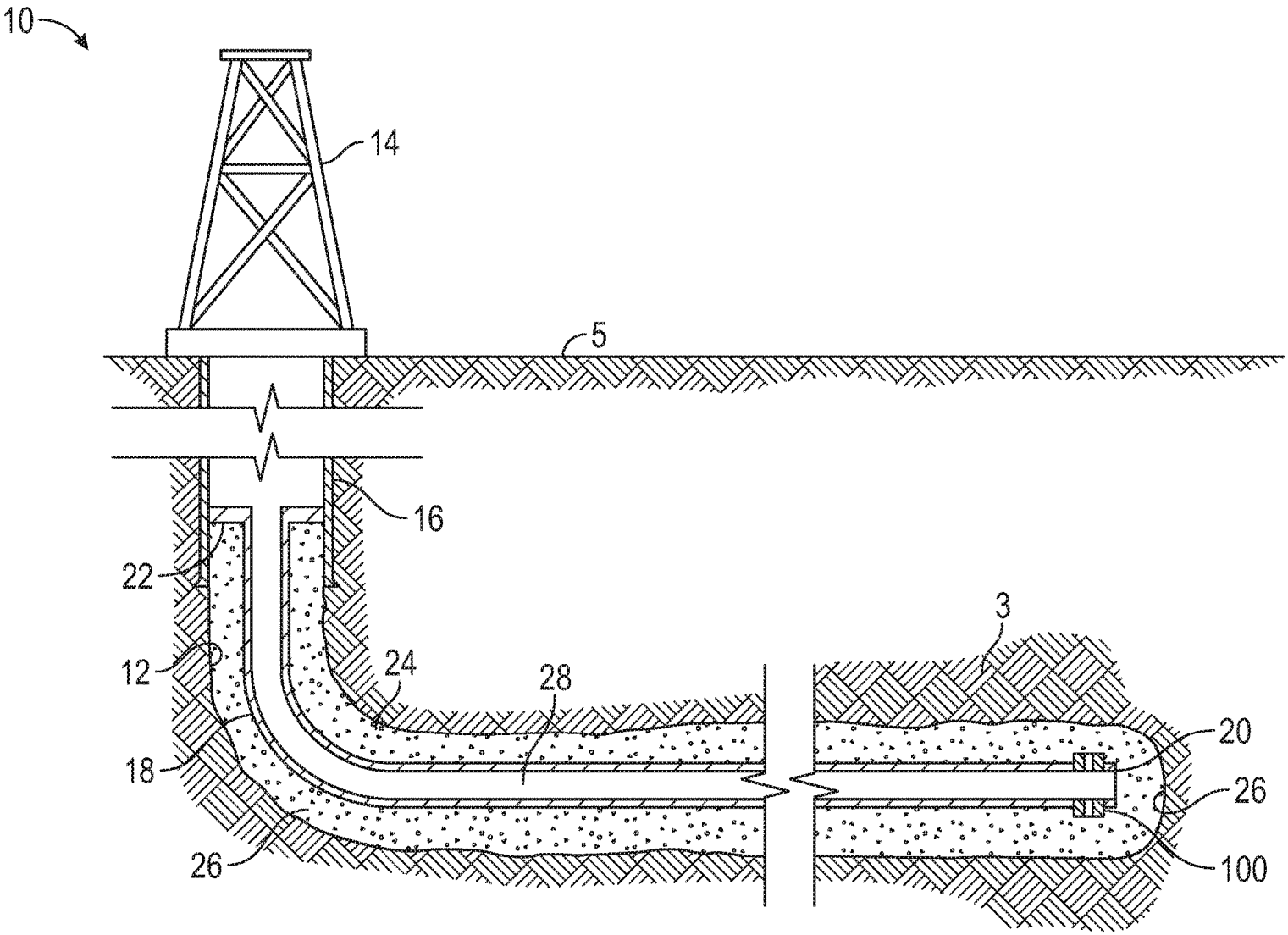
FIG. 1 is a schematic view of a well system including an embodiment of a sliding sleeve valve or toe valve in accordance with principles disclosed herein, the valve positioned at the borehole toe in the exemplary embodiment shown.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring to FIG. 1, a well system 10 including a sliding sleeve or toe valve 100 is shown. In the embodiment of FIG. 1, well system 10 generally includes a borehole 12 extending into a subterranean earthen formation 3 from a surface 5, a derrick or platform 14 disposed at the surface 5, a casing string 16 extending into borehole 12 and supported from the surface 5, and a liner or casing string 18 extending through the borehole 12 and supported by the casing string 16, where casing 18 includes a resettable or testable toe valve 100 disposed at a lower end 20 thereof. Particularly, casing 18 comprises an anchor or hanger 22 physically coupled to an inner surface of casing string 16. In this embodiment, casing 18 is cemented into borehole 12, with cement 24 disposed in the annulus formed between the outer surface of casing 18 and the inner surface of borehole 12, including the region formed between the lower end 20 of casing 18 and the terminal end or "toe" 26 of borehole 12. While in the embodiment of FIG. 1 well system 10 includes a casing 18 supported by a casing string 16, in other embodiments, well system 10 may include a continuous casing or liner string extending from the surface 5 that is cemented within borehole 12, where the continuous casing or liner string includes a testable toe valve 100 proximal a lower end thereof.

In this embodiment, casing 18 includes a plurality of sliding sleeve valves (not shown) disposed between toe valve 100 and a "heel" 26 of borehole 12, where each sliding sleeve valve is configured to be opened following the landing of a ball or dart therein. The sliding sleeve valves of casing 18 may be used to hydraulically fracture predetermined sections of formation 3 to provide for controlled fluid communication between formation 3 and a central bore or passage 28 of casing 18. In this embodiment, toe valve 100 is configured to provide for the pressure testing of casing 18 and cement 24 prior to the initiation of the hydraulic fracturing of formation 3.

Particularly, as will be discussed further herein, toe valve 100 is configured to allow for the application of a test pressure within central passage 28 that comprises a predetermined applied surface pressure and a hydrostatic pressure of fluid disposed in central passage 28 to determine if casing 18 and cement 24 successfully isolate formation 3 from central passage 28. In other words, toe valve 100 is configured to allow for the testing of casing 18 and cement 24 to determine whether these components may isolate a predetermined applied surface pressure within central passage 28 from the formation 3. Additionally, following a successful test of casing 18 and cement 24, toe valve 100 is configured to actuate or move to an open position to allow for the communication of fluid from the portion of central passage 28 disposed proximal the lower end 20 of liner 18 to the formation 3, thereby allowing for the subsequent hydraulic fracturing of the formation 3.

Figure 2:
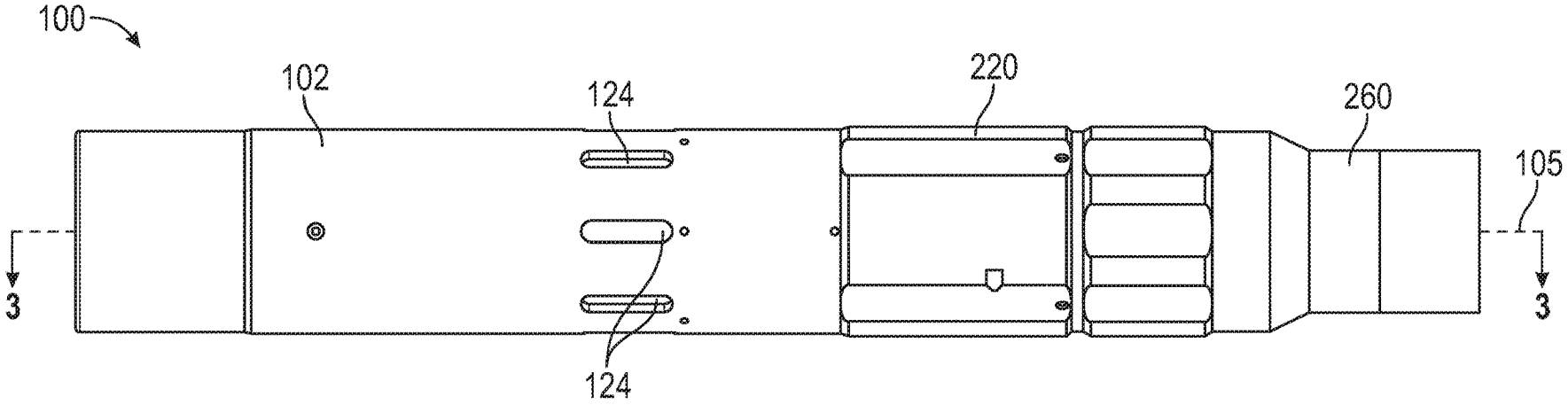
FIG. 2 is a side view of the toe valve of FIG. 1.
Figure 3:
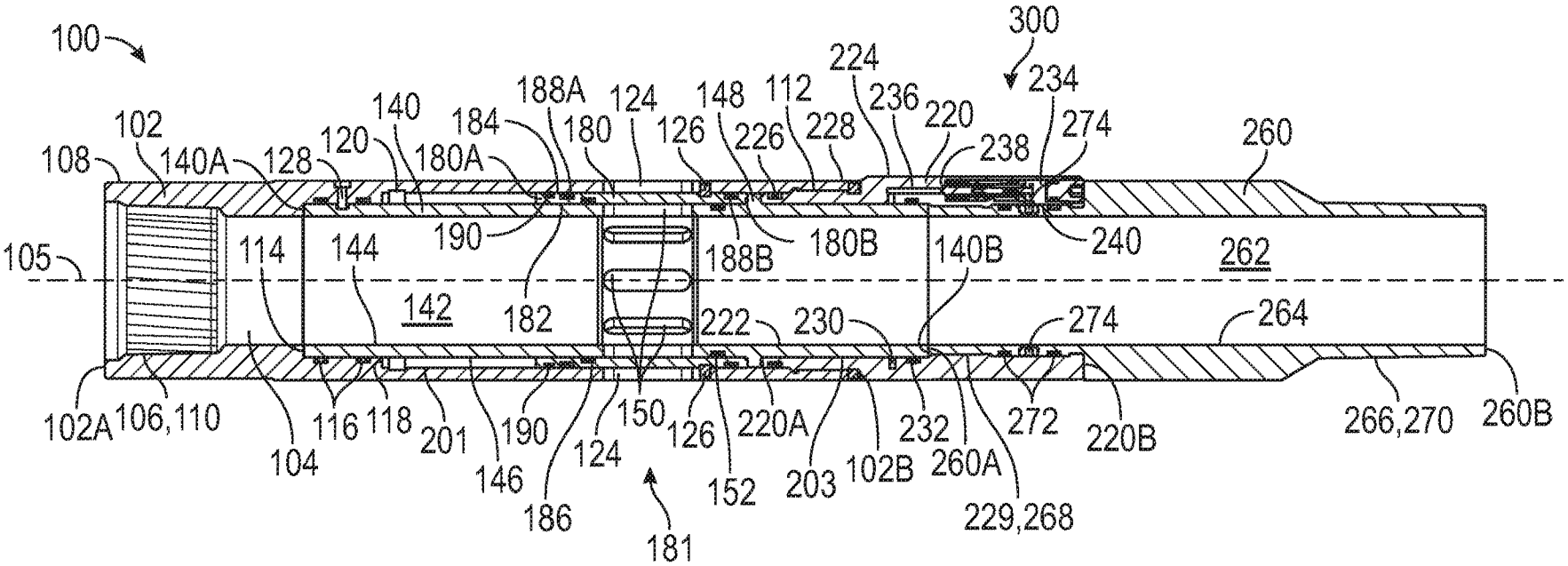
FIG. 3 is a cross-sectional view along line 3-3 of FIG. 2 of the toe valve of FIG. 1.
Figure 4:
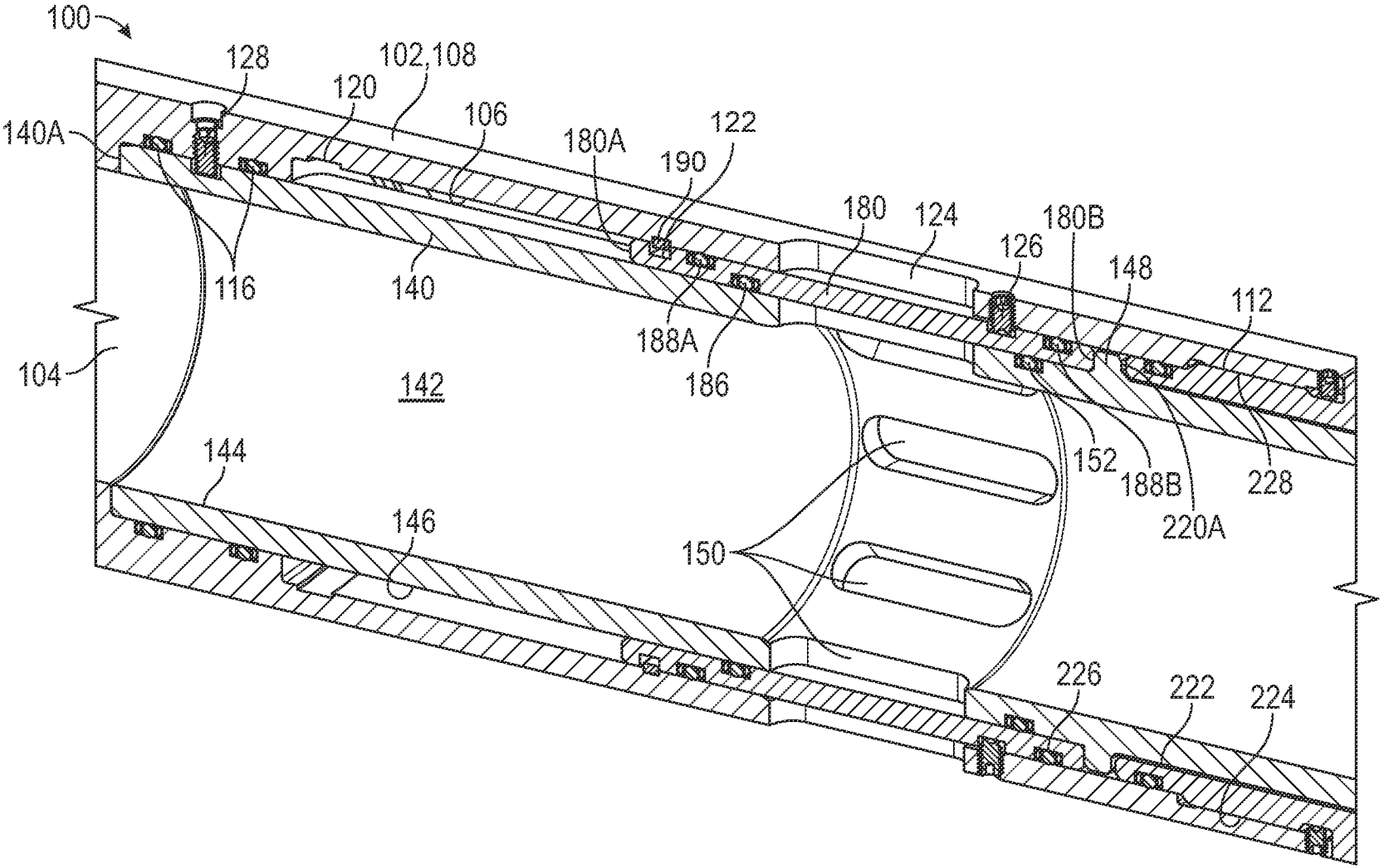
FIG. 4 is an enlarged, cross-sectional view of an embodiment of a sliding sleeve of the toe valve of FIG. 1 in a first position in accordance with principles disclosed herein.
Figure 5:
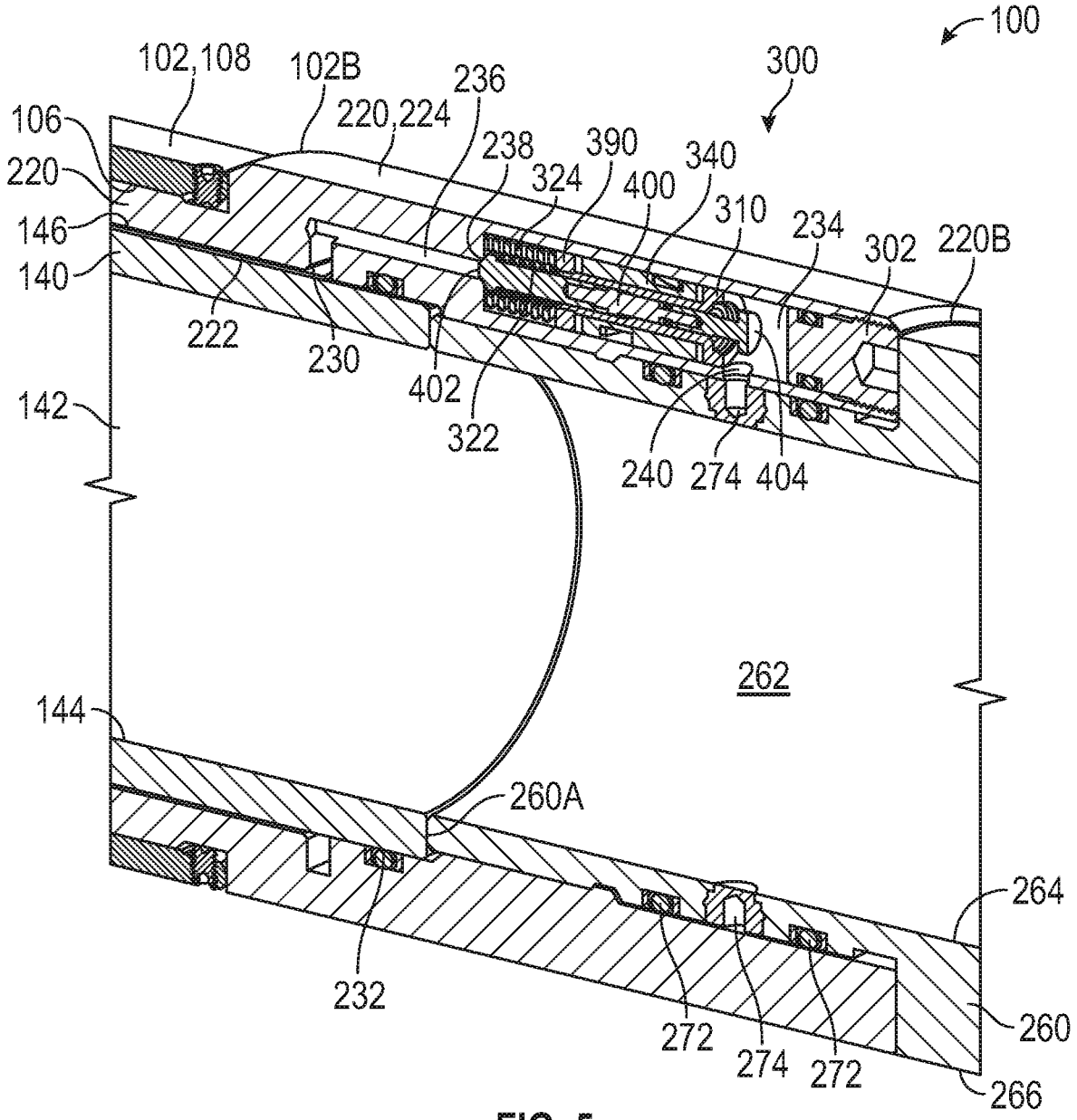
FIG. 5 is an enlarged, cross-sectional view of an embodiment of a poppet valve housing of the toe valve of FIG. 1 in accordance with principles disclosed herein.

Referring to FIGS. 1-5, an embodiment of the testable sliding sleeve or toe valve 100 of the well system 10 of FIG. 1 is shown in FIGS. 2-5. In the embodiment of FIGS. 2-4, toe valve 100 has a central or longitudinal axis 105 and generally includes a first or upper sub 102, an inner mandrel 140, a sliding sleeve 180, an actuator or poppet valve housing 220 that receives an actuator or poppet valve assembly 300 therein, and a second or lower sub 260. Poppet valve housing 220 may also be referred to herein as actuator housing 220. As described above, toe valve 100 is included in or formed with casing 18 proximal the lower end 20 thereof. Although in this embodiment toe valve 100 only includes a single poppet valve assembly 300, in other embodiments, toe valve 100 may comprise multiple poppet valve assemblies 300 received in a plurality of corresponding circumferentially spaced poppet valve chambers 234 formed in poppet valve housing 220. Poppet valve chambers 234 may also be referred to herein as actuation chambers 234 or cylindrical actuation chambers 234.

In this embodiment, upper sub 102 is generally cylindrical and includes a first or upper end 102A, a second or lower end 102B, a central bore or passage 104 defined by a generally cylindrical inner surface 106 extending between ends 102A, 102B, and a generally cylindrical outer surface 108 extending between ends 102A, 102B. The upper end 102A of upper sub 102 defined a first or upper end of toe valve 100. In this embodiment, the inner surface 106 of upper sub 102 includes a first or upper releasable or threaded connector 110 at upper end 102A and a second or lower releasable or threaded connector 112 at lower end 102B. Upper connector 110 comprises a "box" connector for coupling with a "pin" connector formed on the lower end of a joint of casing 18 while lower threaded connector 112 threadably couples with poppet valve housing 220, as will be described further herein. In this embodiment, inner surface 106 also comprises a first or upper annular shoulder 114, a pair of axially spaced, annular seal assemblies 116, and a second or lower annular shoulder 118, where seal assemblies 116 are positioned axially between shoulders 114, 118.

Additionally, as shown particularly in FIG. 4, the inner surface 106 of upper sub 102 also includes an annular groove 120 axially positioned between lower shoulder 118 and the lower end 102B of upper sub 102. In this embodiment, upper sub 102 includes a plurality of circumferentially spaced elongate slots 124, where each slot 124 extends radially between inner surface 106 and outer surface 108. Additionally, upper sub 102 includes a plurality of circumferentially spaced shear pins 126 that extend radially into central bore 104 from inner surface 106. Further, in this embodiment, upper sub 102 includes a retention member 128 that extends radially into central bore 104 of upper sub 102 and releasably couples upper sub 102 with inner mandrel 140, where inner mandrel 140 is received at least partially in central bore 104.

In this embodiment, inner mandrel 140 of toe valve 100 is generally cylindrical and includes a first or upper end 140A, a second or lower end 140B, a central bore or passage 142 defined by a generally cylindrical inner surface 144 extending between ends 140A, 140B, and a generally cylindrical outer surface 146 extending between ends 140A, 140B. As described above, inner mandrel 140 is coupled to upper sub 102 via retention member 128, where retention member 128 engages the outer surface 146 of inner mandrel 140 proximal upper end 140A of inner mandrel 140. In this arrangement, inner mandrel 140 is rotationally and axially locked relative to upper sub 102. Additionally, seal assemblies 116 of upper sub 102 sealingly engage the outer surface 146 of inner mandrel 140 proximal upper end 140A. In this embodiment, the outer surface 146 of inner mandrel 140 includes an annular flange 148 extending radially outwards therefrom, where the outer surface 146 of flange 148 is disposed directly adjacent the inner surface 106 of upper sub 102. Flange 148 of inner mandrel 140 is positioned axially between sliding sleeve 180 and poppet valve housing 220.

In this embodiment, inner mandrel 140 includes a plurality of circumferentially spaced elongate slots 150, where each slot 150 extends radially between inner surface 144 and outer surface 146 of inner mandrel 140. In this embodiment, slots 150 of inner mandrel 140 are circumferentially aligned with slots 124 of upper sub 102; however, in other embodiments, slots 150 of inner mandrel 140 may be circumferentially spaced relative to slots 124 of upper sub 102. Further, in this embodiment, outer surface 146 of inner mandrel 140 includes an annular seal assembly 152 located axially between slots 150 and flange 148, where seal assembly 152 sealingly engages sliding sleeve 180.

In this embodiment, sliding sleeve 180 of toe valve 100 is generally cylindrical and includes a first or upper end 180A, a second or lower end 180B, a central bore or passage defined by a generally cylindrical inner surface 182 extending between ends 180A, 180B, and a generally cylindrical outer surface 184 also extending between ends 180A, 180B.

In this embodiment, the inner surface 182 of sliding sleeve 180 includes an annular inner seal assembly 186 positioned proximal upper end 180A, where inner seal assembly 186 sealingly engages the outer surface 146 of inner mandrel 140. In this embodiment, the outer surface 184 of sleeve 180 includes a pair of annular outer seal assemblies 188A, 188B, where each outer seal assembly 188A, 188B, is positioned proximal an end 180A, 180B, respectively. The sealing engagement provided by inner seal assembly 186, outer seal assembly 188A, and seal assemblies 116 of upper sub 102, forms an annular first or upper atmospheric chamber 201, where upper atmospheric chamber 201 is positioned radially between the inner surface 106 of upper sub 102 and the outer surface 146 of inner mandrel 140. An upper end of the upper atmospheric chamber 201 is defined by seal assemblies 116 of upper sub 102 while a lower end of upper atmospheric chamber 201 is defined by outer seal assembly 188A and inner seal assembly 186 of sliding sleeve 180.

Figure 11:
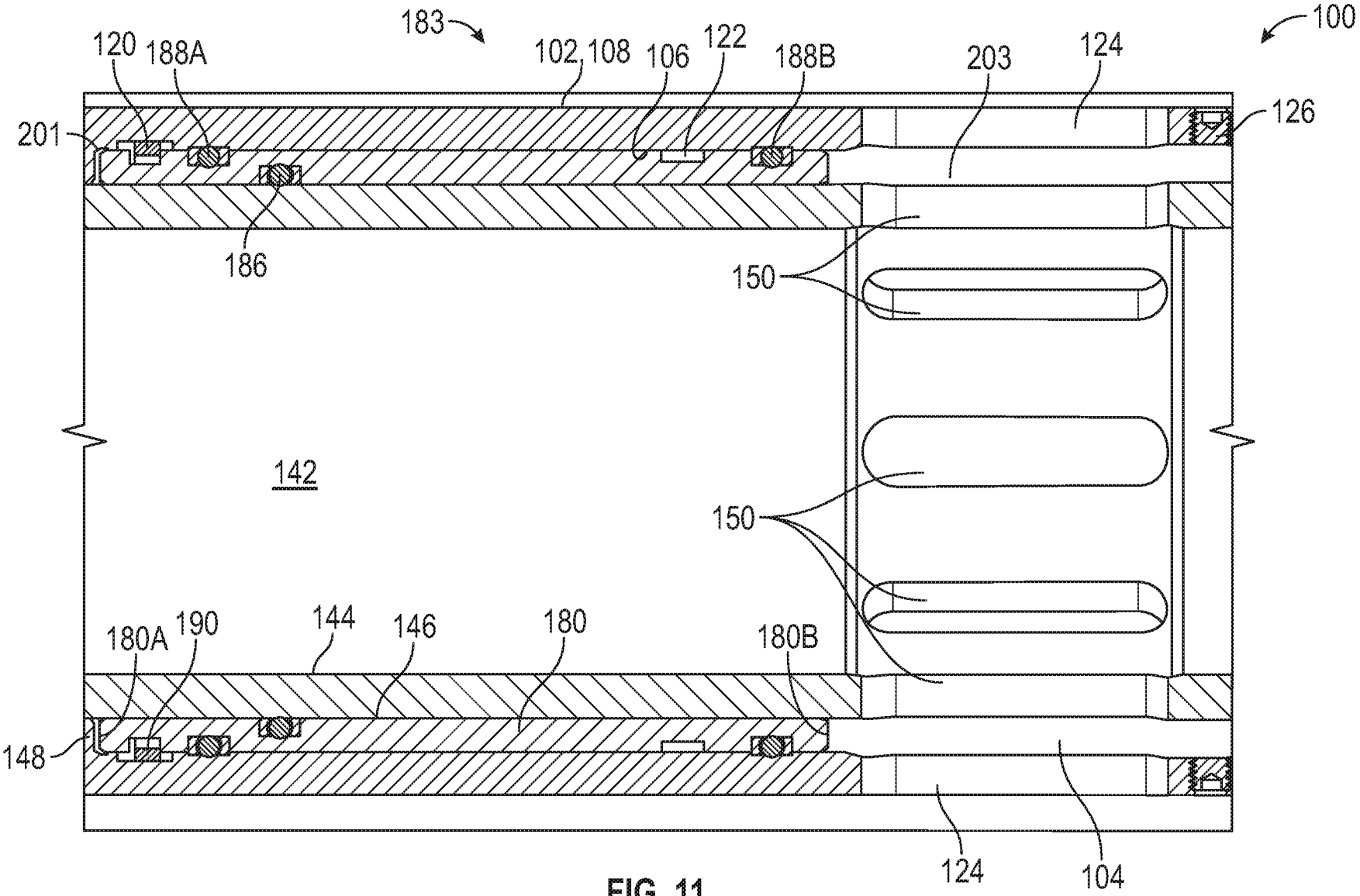
FIG. 11 is a side cross-sectional view of the sliding sleeve of FIG. 4 disposed in a second position.
Figure 12:
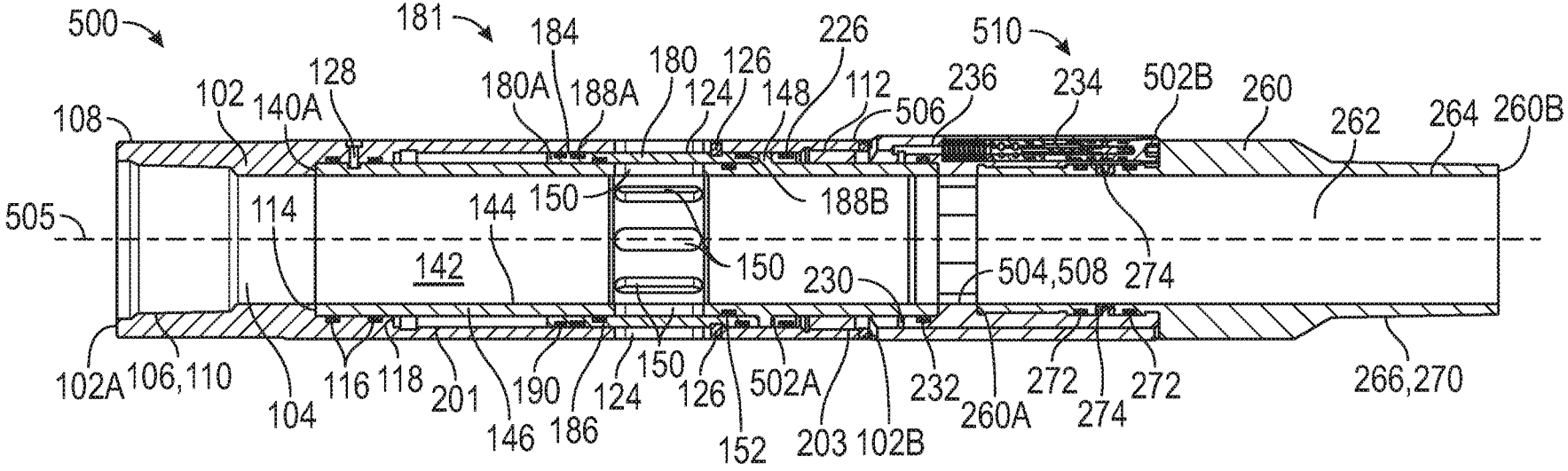
FIG. 12 is a side view of another embodiment of a sliding sleeve valve or toe valve of the well system of FIG. 1 in accordance with principles disclosed herein.
Figure 13:
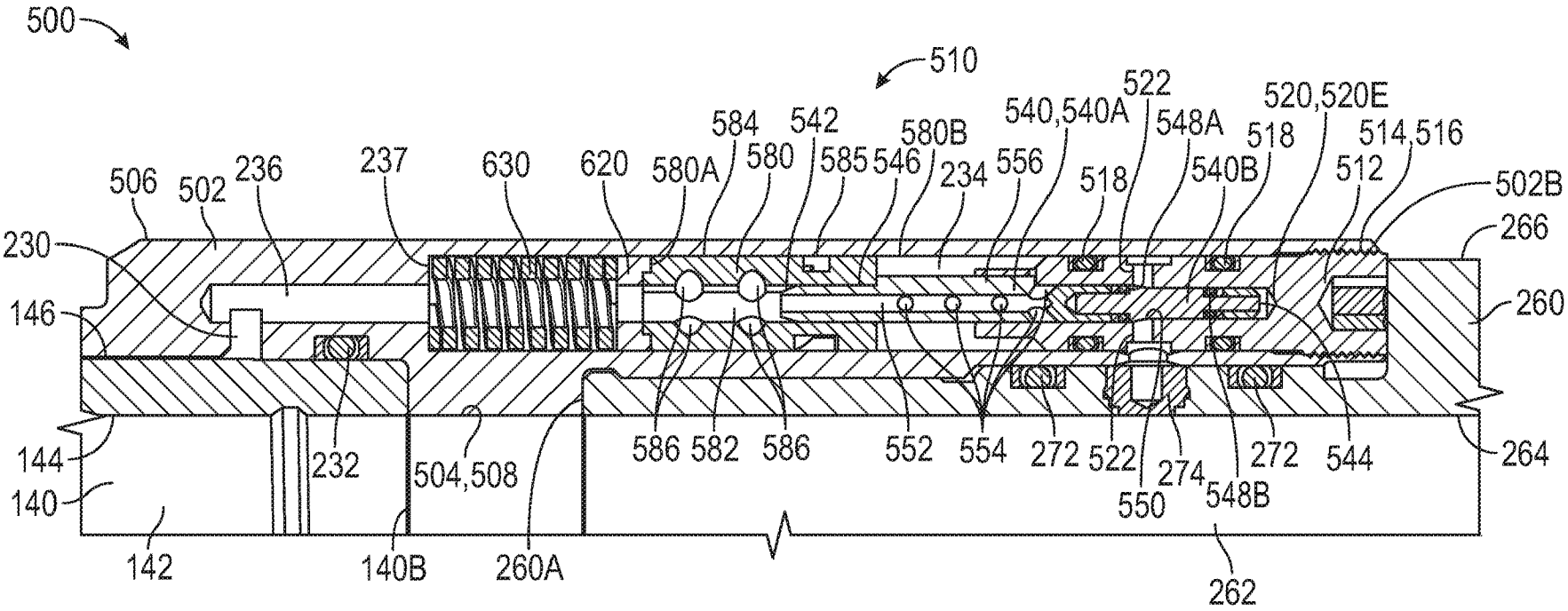
FIG. 13 is a side cross-sectional view of an embodiment of a poppet valve assembly of the toe valve of FIG. 12 disposed in a first position in accordance with principles disclosed herein.

In this embodiment, the outer surface 184 of sliding sleeve 180 includes an annular, radially outwards biased lock ring 190 positioned in an annular groove 192 formed therein, where lock ring 190 is axially located between upper end 180A and the outer seal assembly 188A. As will be discussed further herein, sliding sleeve 180 is axially slidable or moveable relative to both upper sub 102 and inner mandrel 140. Particularly, sliding sleeve 180 is moveable or actuatable between a first or lower position 181 shown in FIG. 3 and a second or upper position 183 shown in FIG. 11. In lower position 181 of sliding sleeve 180, shear pins 126 extend into the outer surface 184 of sliding sleeve 180, releasably or frangibly locking sliding sleeve 180 into lower position 181. Additionally, in lower position 181, lock ring 190 is biased into or received in the groove 192 of sliding sleeve 180.

Further, in lower position 181, fluid communication between bore 142 of inner mandrel 140 and slots 124 of upper sub 102 is restricted. In other words, fluid may not be communicated between toe valve 100 and the surrounding environment (e.g., formation 3). Particularly, in lower position 181 of sliding sleeve 180, the sealing engagement provided by seal assembly 152 of inner mandrel 140, and seal assemblies 186, 188A, and 188B of sleeve 180 restrict fluid communication between slots 150 of inner mandrel 140 and slots 124 of upper sub 124. As will be discussed further herein, sliding sleeve 180 may be actuated or moved into the upper position 183 to provide for fluid communication between toe valve 100 and the surrounding environment.

In this embodiment, poppet valve housing 220 of toe valve 100 is generally cylindrical and includes a first or upper end 220A, a second or lower end 220B, a central bore or passage defined by a generally cylindrical inner surface 222 extending between ends 220A, 220B, and a generally cylindrical outer surface 224 also extending between ends 220A, 220B. The upper end 220A of poppet valve housing 220 is positioned directly adjacent a lower end of the flange 148 of inner mandrel 140. In this embodiment, the outer surface 224 of poppet valve housing 220 includes an annular outer seal assembly 226 located proximal upper end 220A, where outer seal assembly 226 sealingly engages the inner surface of 106 of upper sub 102. In addition, outer surface 224 of poppet valve housing 220 includes a releasable or threaded connector 228 that releasably or threadably connects with the threaded connector 112 of upper sub 102, thereby axially and rotationally locking poppet valve housing 220 to upper sub 102. In some embodiments, additional retention mechanisms may be used to ensure the rotational locking of poppet valve housing 220 to upper sub 102.

In this embodiment, the inner surface 222 of poppet valve housing 220 includes an annular groove 230 and an annular inner seal assembly 232 that sealingly engages the outer surface 146 of inner mandrel 140, where groove 230 is axially positioned between the upper end 220A of poppet valve housing 220 and inner seal assembly 232. Further, in this embodiment, poppet valve housing 220 includes a generally cylindrical actuator or poppet valve chamber 234, where poppet valve chamber 234 extends axially into poppet valve housing 220 from lower end 220B. Poppet valve chamber 234 is defined by a cylindrical inner surface that extends around a central or longitudinal axis 235 (shown in FIG. 6) of poppet valve chamber 234. In this embodiment, the poppet valve chamber 234 has a diameter that is less than the diameter of the central passage of poppet valve housing 220. An actuator or poppet valve passage 236 extends axially through poppet valve housing 220 and between poppet valve chamber 234 and annular groove 230. In this arrangement, an annular valve seat 238 is formed at the intersection of poppet valve chamber 234 and poppet valve passage 236. The sealing engagement provided by outer seal assembly 188B of sliding sleeve 180, seal assembly 152 of inner mandrel 140, and seal assemblies 226 and 232 of poppet valve housing 220, forms an annular second or lower atmospheric chamber 203, where lower atmospheric chamber 203 is generally positioned radially between the inner surface 222 of poppet valve housing 220 and the outer surface 146 of inner mandrel 140. An upper end of the lower atmospheric chamber 203 is defined by seal assemblies 152, 188B, and 226, while a lower end of the lower atmospheric chamber 203 is defined by inner seal assembly 232. In some embodiments, atmospheric chambers 201 and 203 are filled with air or other compressible gasses at atmospheric pressure before toe valve 100 is installed within borehole 12 of well system 10.

As described above, poppet valve chamber 234 is generally cylindrical, and thus, does not extend about an entire circumference of poppet valve housing 220. Additionally, poppet valve chamber 234 is disposed radially between inner surface 222 and outer surface 224 of poppet valve housing 220, and thus, is radially spaced from the central axis 105 of toe valve 100. As will be discussed further herein, poppet valve assembly 300 provides for selective fluid communication between poppet chamber 234 and lower atmospheric chamber 203 via poppet valve passage 236 and annular groove 230. Further, as will be discussed further herein, poppet valve assembly 300 is received within poppet chamber 234, where poppet valve assembly 300 is generally configured for controlling the actuation of sliding sleeve valve 180 between lower position 181 and upper position 183. In other words, poppet valve assembly 300 is configured to control the opening or communication of fluid between toe valve 100 and the surrounding environment.

In this embodiment, lower sub 260 of toe valve 100 is generally cylindrical and includes a first or upper end 260A, a second or lower end 260B, a central bore or passage 262 defined by a generally cylindrical inner surface 264 that extends between ends 260A, 260B, and a generally cylindrical outer surface 266 also extending between ends 260A, 260B. In this embodiment, the lower end 260B of lower sub 260 defines a lower end of toe valve 100. In this embodiment, the outer surface 266 of lower sub 260 includes a first or upper releasable or threaded connector 268 at upper end 260A and a second or lower releasable or threaded connector 270 at lower end 260B. Upper connector 268 threadably connects to a corresponding releasable or threaded connector 229 formed on the inner surface 222 of poppet valve housing 220, thereby rotationally and axially locking lower sub 260 to poppet valve housing 220. In this embodiment, lower connector 270 of lower sub 260 comprises a "pin" connector for coupling with a "box" connector formed on the upper end of a joint of casing 18. In other embodiments, toe valve 100 may comprise a terminal end of casing 18, with lower end 260B of lower sub 260 comprising lower end 20 of casing 18.

In this embodiment, the outer surface 266 of lower sub 260 also includes a pair of axially spaced, annular seal assemblies 272 that sealingly engage the inner surface 222 of poppet valve housing 220 proximate the lower end 220B of poppet valve housing 220. Further, in this embodiment, lower sub 260 includes a plurality of circumferentially spaced burst or rupture disks 274, where each rupture disk 274 is positioned between inner surface 264 and outer surface 266 of lower sub 260. Each rupture disk 274 is axially positioned between seal assemblies 272 and is axially aligned with a plurality of circumferentially spaced ports 240 formed in the inner surface 222 of poppet valve housing 220. As will be discussed further herein, rupture disks 274 are configured to burst or rupture when a predetermined fluid test pressure is reached within bore 262 of lower sub 260. Once at least one of rupture disks 274 has ruptured, fluid communication is established between bore 262 of lower sub 260 and poppet valve chamber 234 of poppet valve 230. In other embodiments, instead of rupture disks 274, lower sub 260 may include one or more circumferentially spaced ports in axial alignment with ports 240 of poppet valve housing 220.

Referring to FIGS. 1 and 6-9, an embodiment of the poppet valve assembly 300 of the toe valve 100 of FIGS. 2-5 is shown in FIGS. 6-9. In the embodiment of FIGS. 6-9, poppet valve assembly 300 generally includes a plug 302, an indexing piston 310, an indexing sleeve 340, an indexing pin 360, a retainer 390, and a valve stem 400. In this embodiment, plug 302 includes a generally cylindrical outer surface 304 that comprises a releasable or threaded connector 306 located at a lower end of plug 302 and an annular seal assembly 308 located proximal an upper end of plug 302. Threaded connector 306 couples with a corresponding threaded connector formed on a generally cylindrical inner surface 235 of poppet valve chamber 234 while seal assembly 308 sealingly engages inner surface 235, thereby restricting fluid communication between poppet valve chamber 234 and the environment surrounding toe valve 100.

Indexing piston 310 of poppet valve assembly 300 has a first or upper end 310A, a second or lower end 310B, a central bore or passage defined by a generally cylindrical inner surface 312 extending between ends 310A, 310B, and a generally cylindrical outer surface 314 extending between ends 310A and 310B. In this embodiment, the inner surface 312 of indexing piston 310 includes an annular inner shoulder 316 while the outer surface 314 of piston 310 includes an annular outer shoulder 318 axially located proximal lower end 310B. Indexing sleeve 340 is generally cylindrical and includes a first or upper end 340A, a second or lower end 340B, a central bore or passage that receives indexing piston 310, and a generally cylindrical outer surface 342 extending between ends 340A and 340B. In this embodiment, the outer surface 342 of indexing sleeve 340 includes an indexing groove or J-slot 344 that extends at least partially along the circumference of indexing sleeve 340.

Figure 9:
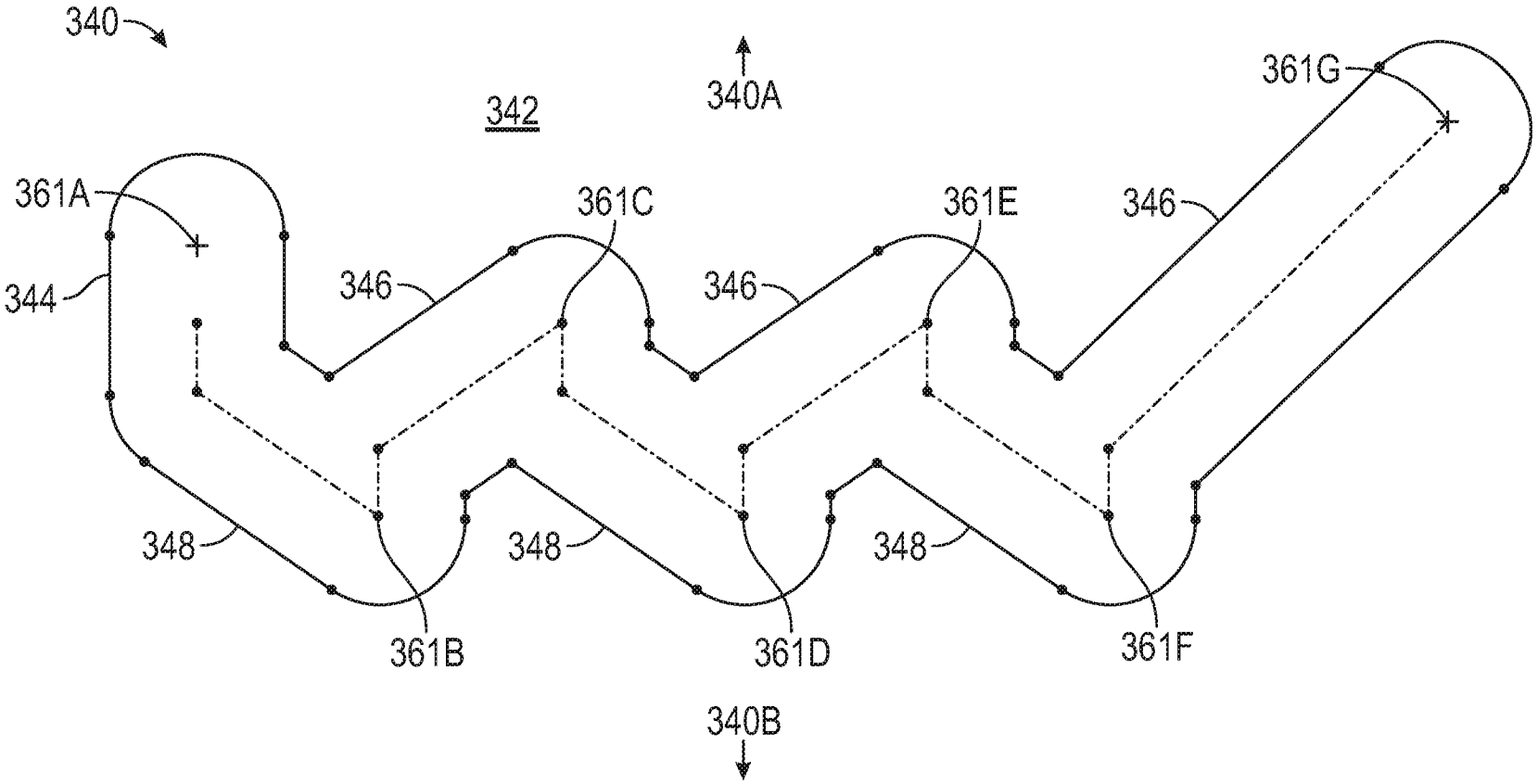
FIG. 9 is a schematic view of an embodiment of an indexing sleeve of the poppet valve assembly of FIG. 6 in accordance with principles disclosed herein.
Figure 10:
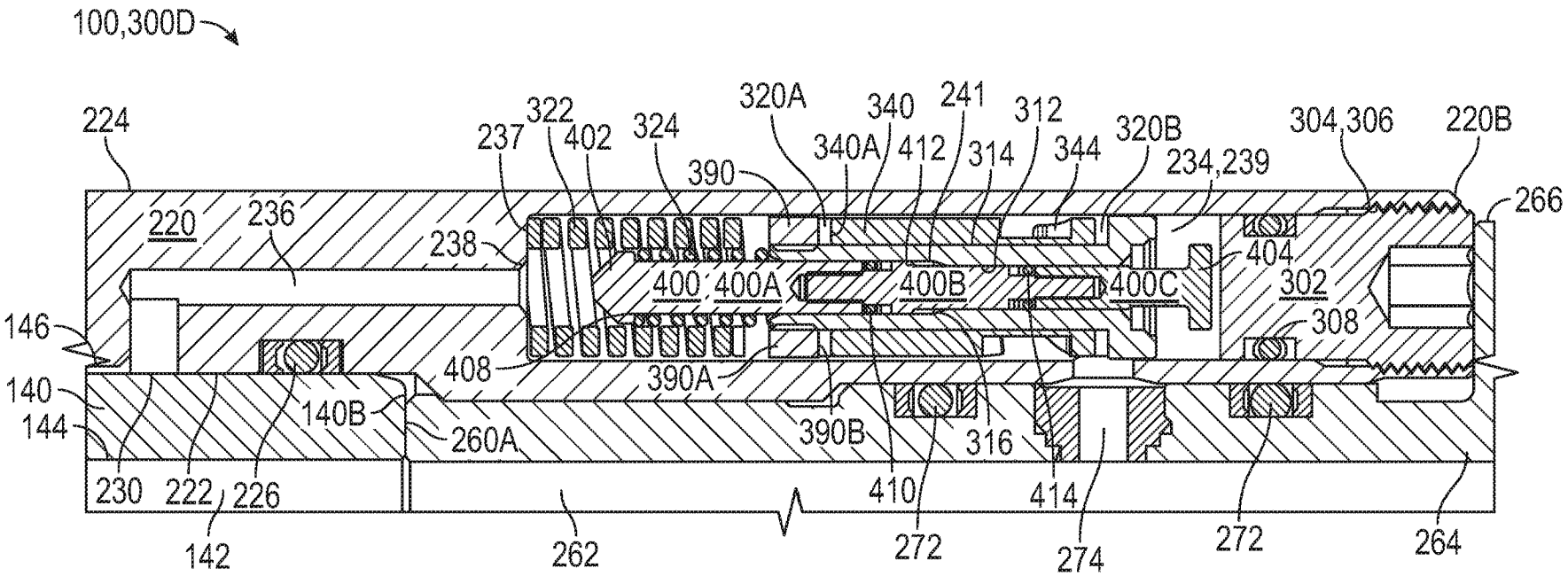
FIG. 10 is a side cross-sectional view of the poppet valve assembly of FIG. 6 disposed in a second position.

As shown particularly in FIG. 9, in this embodiment, J-slot 344 includes or is partially defined by a plurality of circumferentially spaced first or upper shoulders 346 and a plurality of circumferentially spaced second or lower shoulders 348. Shoulders 346 and 348 of J-slot 344 extend along outer surface 342 of indexing sleeve 340 at an angle relative to the circumference of sleeve 340, where upper shoulders 346 are disposed closer to upper end 340A of sleeve 340 relative lower shoulders 348 while lower shoulders 348 are disposed closer to lower end 340B of sleeve 340 relative to upper shoulders 346. Indexing pin 360 of poppet valve assembly 300 is generally cylindrical and extends radially into poppet valve chamber 340 (e.g., radially relative to a central axis of chamber 340). As will be further described herein, indexing sleeve 340 is axially moveable with indexing piston 310 through poppet valve chamber 234, and is permitted to rotate relative to indexing piston 310. In other words, while indexing piston 310 and indexing sleeve 340 may each move axially through poppet valve chamber 234, indexing sleeve 340 may not move axially relative to indexing piston 310.

In this embodiment, indexing pin 360 has a first or outer end 360A, a second or inner end 360B, a generally cylindrical outer surface 362 extending between ends 360A and 360B. Indexing pin 360 is received within a slot 242 that extends radially into poppet valve housing 220 from the outer surface 224 of poppet valve housing 220. In this embodiment, the outer surface 362 of indexing pin 360 includes a releasable or threaded connector 364 that threadably connects to a corresponding threaded connector formed on an inner surface of slot 242, thereby locking indexing pin 360 to poppet valve housing 220. Additionally, the outer surface 362 of indexing pin 360 includes an annular seal assembly 366 that sealingly engages the inner surface of slot 242 to restrict fluid communication between poppet valve chamber 234 and the environment surrounding toe valve 100. As shown particularly in FIG. 8, the inner end 360B of indexing pin 360 is received in the J-slot 244 of indexing sleeve 340. In this arrangement, physical engagement or contact between the inner end 360B of indexing piston 360 and the shoulders 346 and 348 of J-slot 344 limits or controls the axial and rotational movement of indexing sleeve 340 within poppet valve chamber 234. Given that indexing pin 260 limits the axial positioning of indexing sleeve 340 within poppet valve chamber 234, indexing pin 260 also limits the axial positioning of indexing piston 310 within poppet valve chamber 234, where indexing piston 310 is axially locked to indexing sleeve 340.

Retainer 390 of poppet valve assembly is generally cylindrical and has a first or upper end 390A, a second or lower end 390B, and a central bore or passage that receives indexing piston 310. In this embodiment, retainer 390 is coupled to the outer surface 314 of indexing piston 310 at upper end 310A. In this embodiment, a first or upper annular bearing 320A is axially located between the lower end 390B of retainer 390 and the upper end 340A of indexing sleeve 340, while a second or lower annular bearing 320B is axially located between the lower end 340B of indexing sleeve 340 and the outer shoulder 318 of indexing piston 310, where annular bearings 320A and 320B reduce friction between indexing piston 310 and indexing sleeve 340 when sleeve 340 rotates relative to piston 310. Additionally, in this embodiment, poppet valve assembly 300 includes an annular first or outer biasing member 322 that extends between and physically engages the upper end 390A of retainer 390 and an upper terminal end 237 of poppet valve chamber 234. In this arrangement, outer biasing member 322 biases indexing piston 310 and indexing sleeve 340 downwards towards plug 302.

Valve stem 400 is generally cylindrical and includes a first or upper end 402, a second or lower end 404, and a generally cylindrical outer surface 406 extending between ends 402 and 404. In this embodiment, valve stem 400 comprises a plurality of valve stem members 400A, 400B, and 400C coupled together; however, in other embodiments, valve stem 400 may comprise a single member extending between ends 402 and 404. In this embodiment, the outer surface 406 of valve stem 400 includes a first or upper annular shoulder 408 located proximal upper end 402, a first or upper annular seal assembly 410 that sealingly engages the inner surface 312 of indexing piston 310, a second or intermediate annular shoulder 412, a second or lower annular seal assembly 414 axially spaced from upper annular seal 410 that also sealingly engages inner surface 312, and a third or lower annular shoulder 416 located proximal lower end 404. In this embodiment, upper annular seal assembly 410 has a larger diameter than lower annular seal assembly 414. Additionally, in this embodiment, poppet valve assembly 300 further includes an annular second or inner biasing member 324 that extends between and physically engages upper shoulder 408 of valve stem 400 and the upper end 310A of indexing piston 310. In this arrangement, inner biasing member 324 biases the upper end 402 of valve stem 400 into sealing engagement with valve seat 238.

Figure 6:
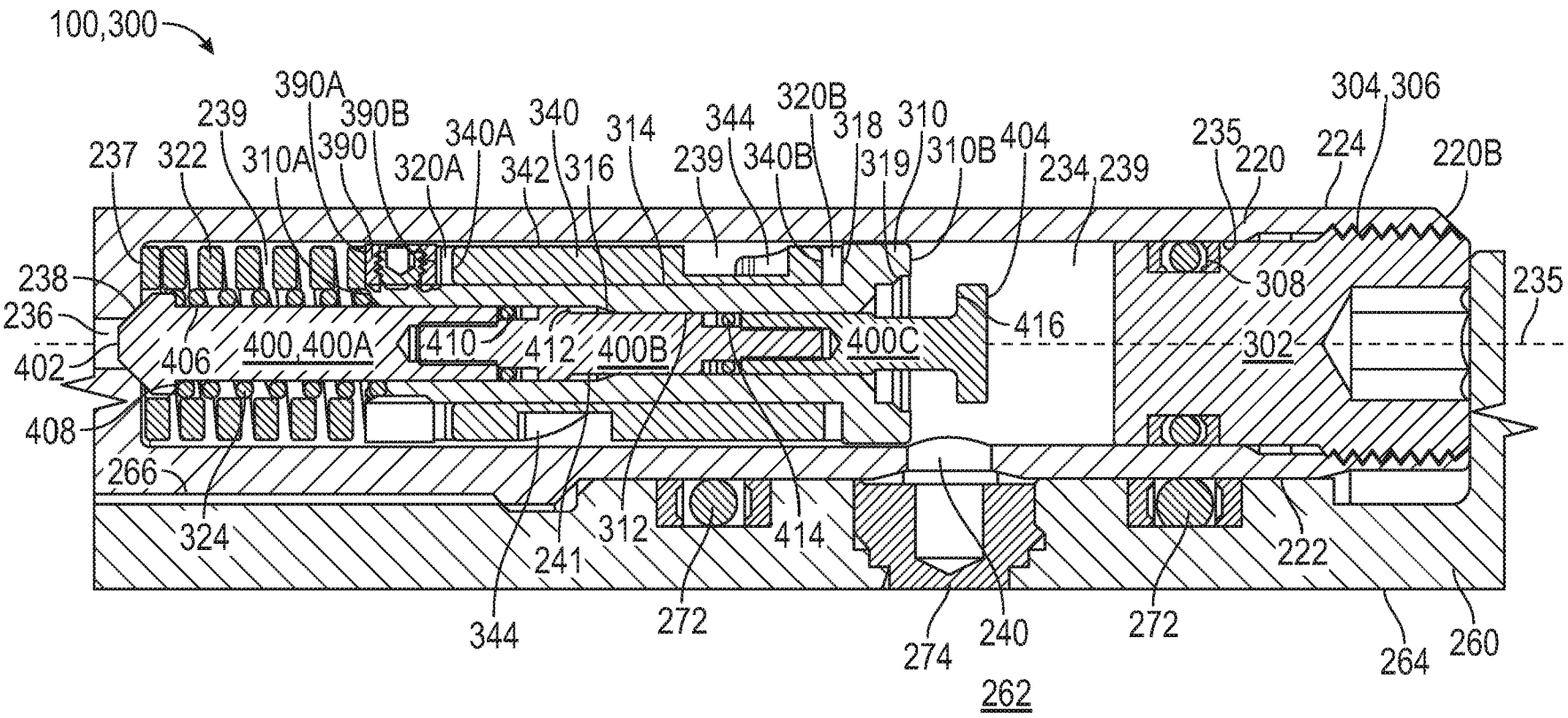
FIG. 6 is a side cross-sectional view of an embodiment of a poppet valve assembly of the toe valve of FIG. 1 disposed in a first position in accordance with principles disclosed herein.
Figure 7:
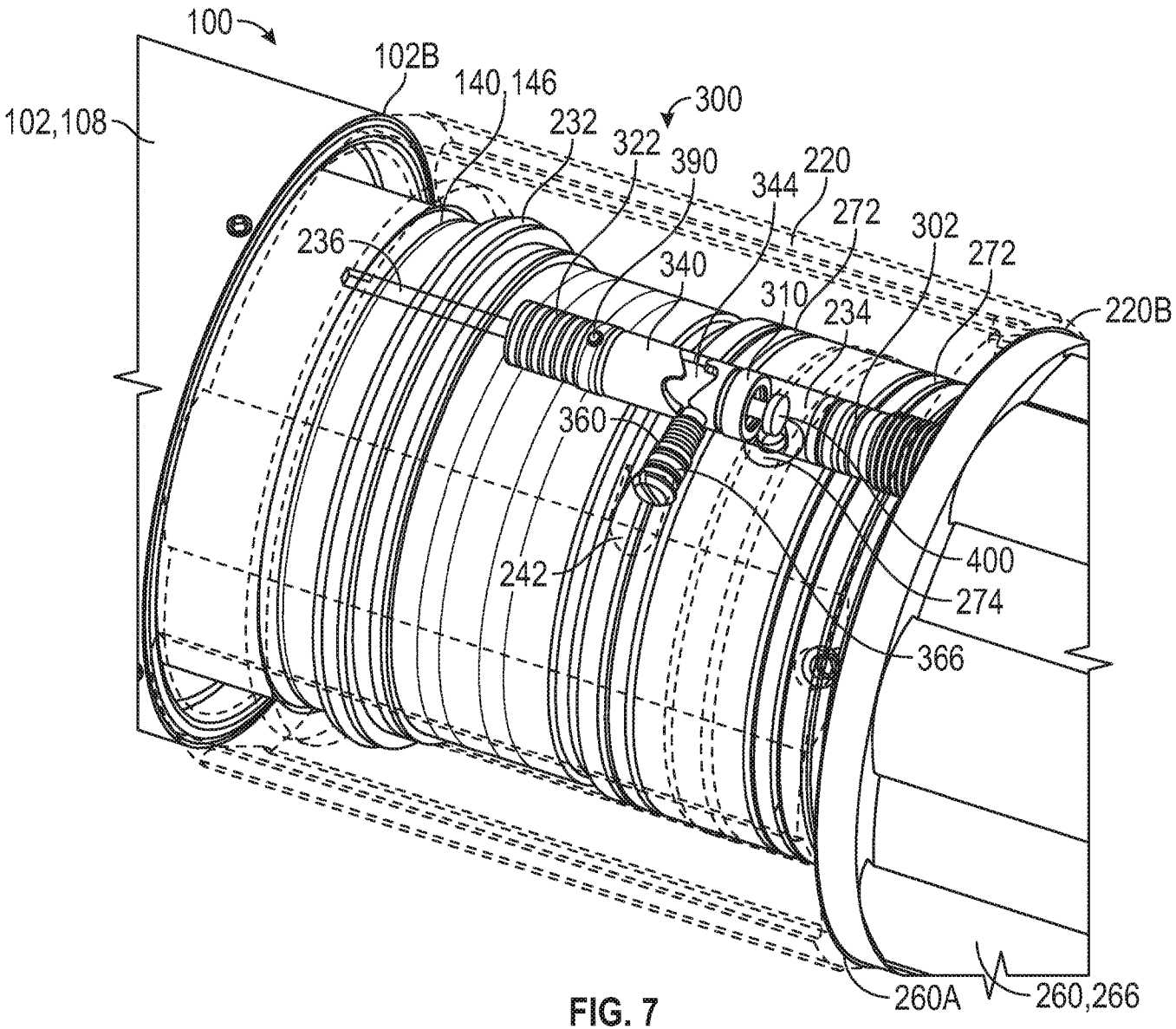
FIG. 7 is a perspective view of the poppet valve assembly of FIG. 6 disposed in the first position.
Figure 8:
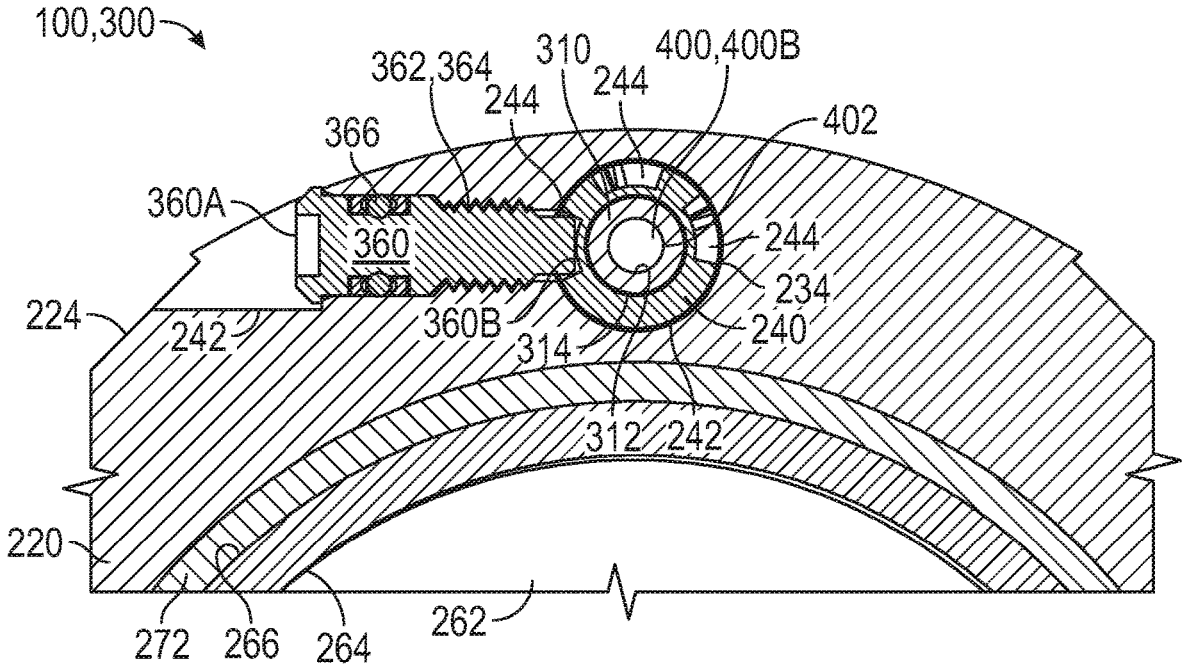
FIG. 8 is a rear cross-sectional view of the poppet valve assembly of FIG. 6 disposed in the first position.

As shown particularly in FIG. 6, the sealing engagement provided by seal assemblies 308, 410, and 414 divides poppet valve chamber 234 into a first generally annular valve chamber 239 and a second generally annular valve chamber 241. Particularly, second valve chamber 241 is disposed radially between the outer surface 406 of valve stem 400 and the inner surface 312 of indexing piston 310, and extends axially between the seal assemblies 410 and 414 of valve stem 400. Conversely, first valve chamber 239 generally extends axially between upper end 237 of valve chamber 234 and the upper end 310A of indexing piston 310, annularly around the outer surface 314 of indexing piston, and axially between the lower end 310B of indexing piston 310 and the seal assembly 308 of plug 302. Additionally, first valve chamber 239 is disposed in the portion of the central bore of indexing piston 310 that extends between upper end 310A of indexing piston 310 and upper seal assembly 410 of valve stem 400, and the portion of the central bore of piston 310 that extends between lower end 310B and lower seal assembly 414 of valve stem 400.

In some embodiments, second valve chamber 241 of poppet valve chamber 234 comprises an atmospheric chamber that is filled with air or other compressible gasses at atmospheric pressure before toe valve 100 is installed within borehole 12 of well system 10. Given that inner shoulder 316 of indexing piston 310, which is disposed in second valve chamber 241, is isolated from pressure within first valve chamber 239, as pressure within first valve chamber 239 increases, a differential pressure force is applied against indexing piston 310 in the direction of the upper end 237 of poppet valve chamber 234. In other words, increasing pressure within first valve chamber 239 results in an increasing pressure force that counteracts the biasing force applied by outer biasing member 322 against indexing piston 310.

Referring to FIGS. 1-11, having described the structure of the embodiments of well system 10 and toe valve 100 shown in FIGS. 1-11, an embodiment of toe valve 100's operation will now be described. Specifically, following the installation and cementing of casing 18 within borehole 12, it may be desirable to pressure test the installed liner 18 and cement 24 to determine whether any inadvertent leakage may occur between borehole 12 and formation 3 during a subsequent hydraulic fracturing of formation 3. Thus, in an embodiment, following the installation and cementing of casing 18, hydraulic pressure is applied to the central passage 28 of liner 18 via one or more pumps disposed at the surface 5 such that a predetermined test pressure is applied to toe valve 100.

Prior to the application of hydraulic pressure at the surface 5, sliding sleeve 180 is disposed in lower position 181, rupture disk 274 seals poppet valve chamber 234 from central passage 28 of casing 18, and the inner end 360B of indexing pin 360 is disposed in a first position 361A (shown in FIG. 9) within the J-slot 344 of indexing sleeve 340, which, in conjunction with the biasing force applied against upper shoulder 408 of valve stem 400, forces the upper end 402 of valve steam 400 into sealing engagement with valve seat 238, thereby sealing poppet valve chamber 234 from lower atmospheric chamber 203. Following the application of hydraulic pressure in central passage 28 from the surface 5, fluid pressure in toe valve 100 is increased until the test pressure is applied to toe valve 100. In some embodiments, the test pressure comprises a fluid pressure greater than both a hydrostatic pressure in passage 28 and a fluid pressure for hydraulically fracturing the formation 3. In other embodiments, the test pressure is substantially equal to the fluid pressure for hydraulically fracturing the formation 3.

Once the test pressure is applied to toe valve 100 from the application of hydraulic pressure at the surface 5, rupture disks 274 each rupture, establishing fluid communication between poppet valve chamber 234 and the bore 262 of lower sub 260 of toe valve 100. Following the rupture of rupture disks 274, pressure is equalized between first valve chamber 239 and bore 262 of the lower sub 260 of toe valve 100, thereby disposing first valve chamber 239 at the test pressure. With first valve chamber 239 disposed at the test pressure, a differential pressure force is applied against indexing piston 310 of poppet valve assembly 300, causing indexing piston 310 to compress outer biasing member 322 and move through poppet valve chamber 234 in the direction of upper end 237. Additionally, as indexing piston 310 moves axially towards upper end 237 of poppet valve chamber 234, indexing sleeve 340 rotates about indexing piston 310 in response to engagement between a first lower shoulder 348 of J-slot 344 and the inner end 360B of indexing pin 360. Particularly, as indexing piston 310 travels axially through poppet valve chamber 234, causing indexing sleeve to travel axially through chamber 234 in concert with indexing piston 310, the inner end 360B of indexing pin 360 travels through J-slot 344, contacts a first lower shoulder 348, and comes to rest in a second position 361B that is axially and circumferentially spaced from first position 361A.

With indexing pin 360 disposed in the second position 361B, the upper end 402 of valve stem 400 remains in sealing engagement with valve seat 238 and sliding sleeve 180 remains in the lower position 181. Casing 18 may be held at the test pressure with pin 360 disposed in second position 361B for as long necessary to complete the pressure test of casing 18 and cement 24. Thus, toe valve 100 allows nearly unlimited flexibility regarding the duration of the first pressure test. For instance, depending on the geometry of borehole 12, casing 18, and parameters relating to the formation 3 and cement 24, it may be advantageous to increase or decrease the temporal length of the pressure test, where toe valve 100 inherently provides for such flexibility.

Once the first pressure test has been completed, the hydraulic pressure applied to central passage 28 of casing from the surface 5 may be released or vented, causing pressure in poppet valve chamber 234 to decrease below the predetermined test pressure. As pressure in poppet valve chamber 234 decreases below the predetermined test pressure, outer biasing member 322 forces indexing piston 310 downwards towards plug 302 (valve stem 400 is held in engagement against valve seat 238 via inner biasing member 324). As indexing piston 310 and indexing sleeve 340 travel downwards through poppet valve chamber 234, the inner end 360B of indexing pin 360 travels through J-slot 344 and physically engages a first upper shoulder 346, causing indexing sleeve 340 to rotate relative to indexing piston 310. Indexing pin 360 continues to travel through J-slot 344 until it comes to rest in a third position 361C that is circumferentially and axially spaced relative to second position 361B. With indexing pin 360 retained in the third position 361C, the upper end 402 of valve stem 400 continues to seal against valve seat 238 and sliding sleeve 180 remains in the lower position 181.

Once the applied hydraulic pressure has been eliminated, with indexing pin 360 retained in the third position 361C, hydraulic pressure may be reapplied at the surface 5 to conduct a second pressure test of casing 18 and cement 24 and thereby dispose toe valve 100 to the predetermined test pressure for a second time. In this manner, toe valve 100 may be "reset" to allow for the performance of multiple pressure tests of casing 18 and cement 24. Moreover, given that poppet valve assembly 300 is disposed within a wall of poppet valve housing 220 (e.g., between inner and outer surfaces 222, 224, respectively, of housing 220), the surface area of indexing piston 310 that receives the pressure force for displacing piston 310 through poppet valve assembly 234 may be reduced, reducing in turn the amount of necessary biasing force provided by outer biasing member 322 and the amount of pressure required for actuating poppet valve assembly 300. In other words, by placing poppet valve assembly 300 within the wall of poppet valve housing 220, toe valve 100 may be economically produced and the flexibility of poppet valve assembly 300 may be increased.

In some applications, it may be advantageous to conduct multiple pressure tests of casing 18 and cement 24 prior to initiating a hydraulic fracturing operation of formation 3. For instance, in some applications the pumps responsible for applying hydraulic pressure to casing 18 at the surface 5 may break down or otherwise be unable to maintain the predetermined test pressure for the predetermined period of time over which the first pressure test is intended to comprise. In some applications, legal regulations may necessitate the performance of multiple pressure tests to sufficiently demonstrate the fluid and pressure isolating capabilities of casing 18 and cement 24.

Toe valve 100 allows multiple pressure tests to be conducted at the same or a similar predetermined test pressure in applications. Particularly, with indexing pin 360 disposed in the third position 361C, hydraulic pressure may simply be reapplied at the surface 5 to expose toe valve 100 and poppet valve chamber 234 to the predetermined test pressure. With poppet valve chamber 234 disposed at the predetermined test pressure, indexing piston 310 is again transported through chamber 234 towards upper end 237, thereby compressing outer biasing member 322 and forcing indexing pin 360 through J-slot 344 of indexing sleeve 340 from the third position 361C to a fourth position 361D. Particularly, as the inner end 360B of indexing pin 360 travels through J-slot 244, pin 360 physically engages a second lower shoulder 348, thereby rotating indexing sleeve 340 relative to indexing piston 310. Indexing pin 360 continues to travel through J-slot 344 until it comes to rest at fourth position 361D, where fourth position 361D is circumferentially spaced from, but axially aligned with, second position 361B. In fourth position 361D of indexing pin 360, the upper end 402 of valve stem 400 remains in sealing engagement with valve seat 238 and sliding sleeve 180 disposed in the lower position 181, thereby allowing for the conduction of a second pressure test of casing 18 and cement 24 for a time period selected by the operator of well system 10.

In the exemplary embodiment of FIGS. 1-11, poppet valve assembly 300 of toe valve 100 allows for the conduction of a third and final pressure test of casing 18 and cement 24 by releasing hydraulic pressure from the surface 5, thereby forcing indexing pin 360 from the fourth position 361D to a fifth position 361E, where fifth position 361E is circumferentially spaced from, but axially aligned with, third position 361C. Subsequently, with indexing pin 360 disposed in the fifth position 361E, hydraulic pressure may be reapplied, for the third time, to the central passage 28 of casing 18, thereby exposing toe valve 100 and poppet valve chamber 234 to the predetermined test pressure for a third time. With poppet valve chamber 234 again exposed to the test pressure, indexing pin 360 is forced through J-slot 344 of indexing sleeve 340 from the fifth position 361E to a sixth position 361F, where sixth position 361F is circumferentially spaced from, but axially aligned with, fourth position 361D.

In this embodiment, in response to the release of the hydraulic pressure applied to passage 28 of casing 18 from the surface 5, and with the indexing pin 360 of poppet valve assembly 300 disposed in the sixth position 361F, poppet valve assembly 300 is configured to actuate sliding sleeve 180 from the lower position 181 to the upper position 183 and thereby establish fluid communication between toe valve 100 and the environment surrounding valve 100. Specifically, by reducing the hydraulic pressure applied to passage 28 of casing 18 from the surface when indexing pin 360 is disposed in the sixth position 361F, indexing pin 360 is forced through J-slot 344 of indexing sleeve 340, contacting a third upper shoulder 346, and is forced into a final seventh position 361G that is both circumferentially and axially spaced from each of the previous positions 361A-361F.

Particularly, the seventh position 361G of indexing pin 360 is closer towards the upper end 340A of indexing sleeve 340 than any other position of indexing pin 360 in this embodiment, including first position 361A. Further, although in this embodiment poppet valve assembly 360 is configured to open toe valve 100 in response to displacing indexing pin 360 into the seventh position 361G following the third pressure test, in other embodiments, poppet valve assembly 300 may open toe valve 100 following the second pressure test, a fourth pressure test, a fifth pressure test, etc. In other words, in other embodiments poppet valve assembly 300 may be configured to open toe valve 100 following a single pressure test of casing 18, following two pressure tests of casing 18, or following more than three pressure tests of casing 18, depending on the application. Particularly, poppet valve assembly 300 may be reconfigured to provide for varying number of pressure tests of casing 18 before opening toe valve 100 by adjusting the geometry of the J-slot 344 of indexing sleeve 340.

In this embodiment, as indexing pin 360 travels through J-slot 344 of indexing sleeve 340 from the sixth position 361F to the seventh position 361G, outer biasing member 322 forces indexing piston 310 upwards through poppet valve chamber 234 a distance sufficient to unseat the upper end 402 of valve stem 400 from valve seat 238, and thereby allow for fluid communication between poppet valve assembly 234 and poppet valve passage 236. Specifically, although inner biasing member, 324 maintains a biasing force against valve stem 400 in the direction of valve seat 238, when indexing pin 360 is forced into the seventh position 361G, the indexing piston 310 has concurrently traveled upwards through poppet valve chamber 234 a sufficient distance such that lower shoulder 416 of valve stem 400 engages a mating annular shoulder 319 of indexing piston 310 before the upper end 402 of valve stem 400 is permitted to unseat from valve seat 238.

In this embodiment, with valve stem 400 unseated from valve seat 238 (shown in FIG. 10), hydraulic pressure within bore 262 of lower sub 260 is communicated or transmitted to the lower atmospheric chamber 203 via poppet valve passage 236 and groove 230. Additionally, although is the test pressure is no longer applied when indexing pin 360 is forced into the seventh position 361G, the remaining hydraulic pressure and hydrostatic pressure from the column of fluid disposed in the central passage 28 of casing 18 applies a differential pressure force across sliding sleeve 180 that is sufficient to shear the shear pins 126 of upper sub 102, thereby permitting relative axial movement between sliding sleeve 180 and upper sub 102. Further, once shear pins 126 are sheared by the pressure force applied to the lower end 180B of sliding sleeve 180 from pressure within lower atmospheric chamber 203, sliding sleeve 180 is displaced upwards into the upper position 183 (shown in FIG. 11), thereby aligning permitting fluid communication between the slots 150 of inner mandrel 140 and the slots 124 of upper sub 102, and, in-turn, permitting fluid flow between toe valve 100 and the environment surrounding toe valve 100, such as the formation 3. Further, when sliding sleeve valve 180 is actuated into the upper position 183, lock ring 190 is biased radially outwards into locking engagement with groove 120 of upper sub 102, thereby locking sliding sleeve 180 into the upper position 181. With sliding sleeve 180 disposed in the upper position 181, a hydraulic fracturing operation of the formation 3 of well system 10 may be initiated. For instance, in some embodiments, one or more balls or darts may be pumped through central passage 28 of casing 18 for landing within corresponding sliding sleeves of liner 18, where the fluid used to transport the balls or darts permitted to exit passage 28 via toe valve 100. Although toe valve 100 and poppet valve assembly 300 is described above in the context of a cementing operation, toe valve 100 and/or poppet valve assembly 300 may also be employed in other applications that utilize multiple pressurizations for setting and/or testing downhole equipment. For instance, toe valve 100 and/or poppet valve assembly 300 may be employed for setting and subsequent pressure testing of downhole packers or other equipment actuated via pressurization. In some embodiments, toe valve 100 may be used prior to perforating casing 18 as part of a "plug and perf" operation.

Referring to FIGS. 12-17, another embodiment of a testable sliding sleeve or toe valve 500 of the well system 10 of FIG. 1 is shown in FIGS. 12-15. Toe valve 500 has features in common with toe valve 100 shown in FIGS. 2-11, and shared features are labeled similarly. In some embodiments, toe valve 500 may be included in or formed with casing 18 proximal the lower end 20 thereof. In the embodiment of FIGS. 12-15, toe valve 500 has a central or longitudinal axis 505 and generally includes upper sub 102, inner mandrel 140, sliding sleeve 180, an actuator or poppet valve housing 502 that receives an actuator or poppet valve assembly 510 therein, and lower sub 260.

In this embodiment, poppet valve housing 502 of toe valve 500 is generally cylindrical and includes a first or upper end 502A, a second or lower end 502B, a central bore or passage defined by a generally cylindrical inner surface 504 extending between ends 502A, 502B, and a generally cylindrical outer surface 506 also extending between ends 502A, 502B. Poppet valve housing 502 is generally similar in configuration to the poppet valve housing 220 of toe valve 100 shown in FIGS. 12-15. However, the inner surface 504 of poppet valve housing 502 includes an annular shoulder 508 formed thereon, where a first or upper end of shoulder 508 is disposed directly adjacent the lower end 140B of mandrel 140 while a second or lower end of shoulder 508 is disposed directly adjacent the upper end 260A of lower sub 260. Thus, in this embodiment, the lower end 140B of mandrel 140 is axially spaced from the upper end 260A of lower sub 260.

As shown particularly in FIGS. 13-17, poppet valve assembly 510 of toe valve 500 is received in the poppet valve chamber 234 of poppet valve housing 502, and is configured to control the actuation of sliding sleeve 180 between the lower position 181 and upper position 183. Particularly, poppet valve assembly 510 is configured to allow for the performance of multiple pressure tests of casing 18 and cement 24 before sliding sleeve 180 is actuated from the lower position 181 to the upper position 183. In this embodiment, poppet valve assembly 510 generally includes a piston housing 512, an indexing piston 540 slidably received in piston housing 512, an indexing sleeve 580, a retainer 620, and a biasing member 630.

In this embodiment, piston housing 512 comprises a generally cylindrical outer surface 514 including a releasable or threaded connector 516 located at a lower end of piston housing 512. Additionally, outer surface 514 includes a pair of axially spaced annular seal assemblies 518 disposed thereon, where seal assemblies 518 sealingly engage the inner surface 235 of poppet valve chamber 234. In this embodiment, an upper end of piston housing 512 includes a generally cylindrical central passage or chamber 520 that extends axially into piston housing 512 from an upper end of piston housing 512 and terminating within piston housing 512 at a terminal end 520E. A plurality of circumferentially spaced ports 522 extend radially between outer surface 514 and central passage 520, providing fluid communication between poppet valve chamber 234 and central passage 520. In this embodiment, the portion of central passage 520 extending axially between the upper end of piston housing 512 and ports 522 has a greater diameter than the portion of central passage 520 extending axially between ports 522 and terminal end 520.

A lower seal assembly 518 of the pair of seal assemblies 518 of piston housing 512 restricts fluid communication between central passage 522 and the environment surrounding toe valve 500. The lower seal assembly 518 also isolates the surrounding environment from indexing piston 540, indexing sleeve 580, and biasing member 630. As shown particularly in FIGS. 15 and 17, in this embodiment, an anti-rotation key 525 is located between the outer surface 514 of piston housing 512 and the inner surface 235 of poppet valve chamber 234, thereby restricting relative rotation between piston housing 512 and poppet valve housing 502. Additionally, in this embodiment, the upper end of piston housing 512 comprises an arcuate, axially extending key 524. As will be described further herein, key 524 of piston housing 512 is configured to restrict relative rotation between piston housing 512 and indexing piston 540 while permitting relative axial movement between piston housing 512 and indexing piston 540.

Indexing piston 540 is generally cylindrical and includes a first or upper end 542, a second or lower end 544, and a generally cylindrical outer surface 546 extending between ends 542 and 544. In this embodiment, indexing piston 540 comprises a plurality of indexing piston members 540A, 540B, coupled together; however, in other embodiments, indexing piston 540 may comprise a single member extending between ends 542 and 544. In this embodiment, the outer surface 546 of indexing piston 540 includes a plurality of axially spaced annular seal assemblies 548A, 548B that sealingly engage the inner surface of central passage 520, and an annular shoulder 550 located axially between the pair of seal assemblies 548A, 548B. In this embodiment, seal assembly 548A has a greater diameter than seal assembly 548B. As will be described further herein, seal assemblies 548A, 548B and shoulder 550 are configured to translate a pressurization of the central passage 520 of piston housing 512 into an axial force applied against indexing piston 540 in the direction of the terminal end 237 due to the larger diameter of seal assembly 548A relative to seal assembly 548B.

In this embodiment, indexing piston 540 includes a central passage 552 extending into indexing piston 540 from upper end 542 to a terminal end formed therein, where the terminal end of central passage 552 is located between upper end 542 and an upper seal assembly 548A of the pair of seal assemblies 548A, 548B. A plurality of axially and circumferentially spaced ports 554 extend radially between the outer surface 546 of indexing piston 540 and central passage 552, thereby providing fluid communication between poppet valve chamber 234 and central passage 552. Additionally, as shown particularly in FIGS. 15 and 17, the outer surface 546 of indexing piston 540 includes a plurality of circumferentially spaced and axially extending keys 556. Each key 556 has an upper end that is axially spaced from the upper end 542 of indexing piston 540 and a lower end that is axially spaced from the lower end 544 of indexing piston 540. Keys 556 of indexing piston 540 are circumferentially spaced such that key 524 of piston housing 512 may be received in an arcuate keyway formed between the circumferentially spaced keys 556. Thus, keys 556 of indexing piston 540 and key 524 of piston housing 512 are disposed in an interlocking relationship that restricts relative rotation between indexing piston 540 and piston housing 512 while permitting relative axial movement between indexing piston 540 and piston housing 512.

In this embodiment, indexing sleeve 580 of poppet valve assembly 510 is generally cylindrical and includes a first or upper end 580A, a second or lower end 580B, a central bore or passage 582 that receives indexing piston 540, and a generally cylindrical outer surface 584 extending between ends 580A and 580B. The outer surface 584 of indexing sleeve 580 includes a J-slot 585 which interfaces with indexing pin 360 in a manner similar to the indexing sleeve 340 of poppet valve assembly 300 shown in FIGS. 2-11. As will be discussed further herein, J-slot 585 shares features in common with J-slot 344 of poppet valve assembly 300, including positions 361A-361F; however, indexing sleeve 580 includes a seventh position 585G and an eighth position 585H rather than the seventh position 361G of J-slot 344. In this embodiment, indexing sleeve 580 includes a plurality of axially and circumferentially spaced ports 586 that extend between outer surface 584 and central passage 582, thereby providing fluid communication between poppet valve chamber 234 and central passage 582.

Figure 14:
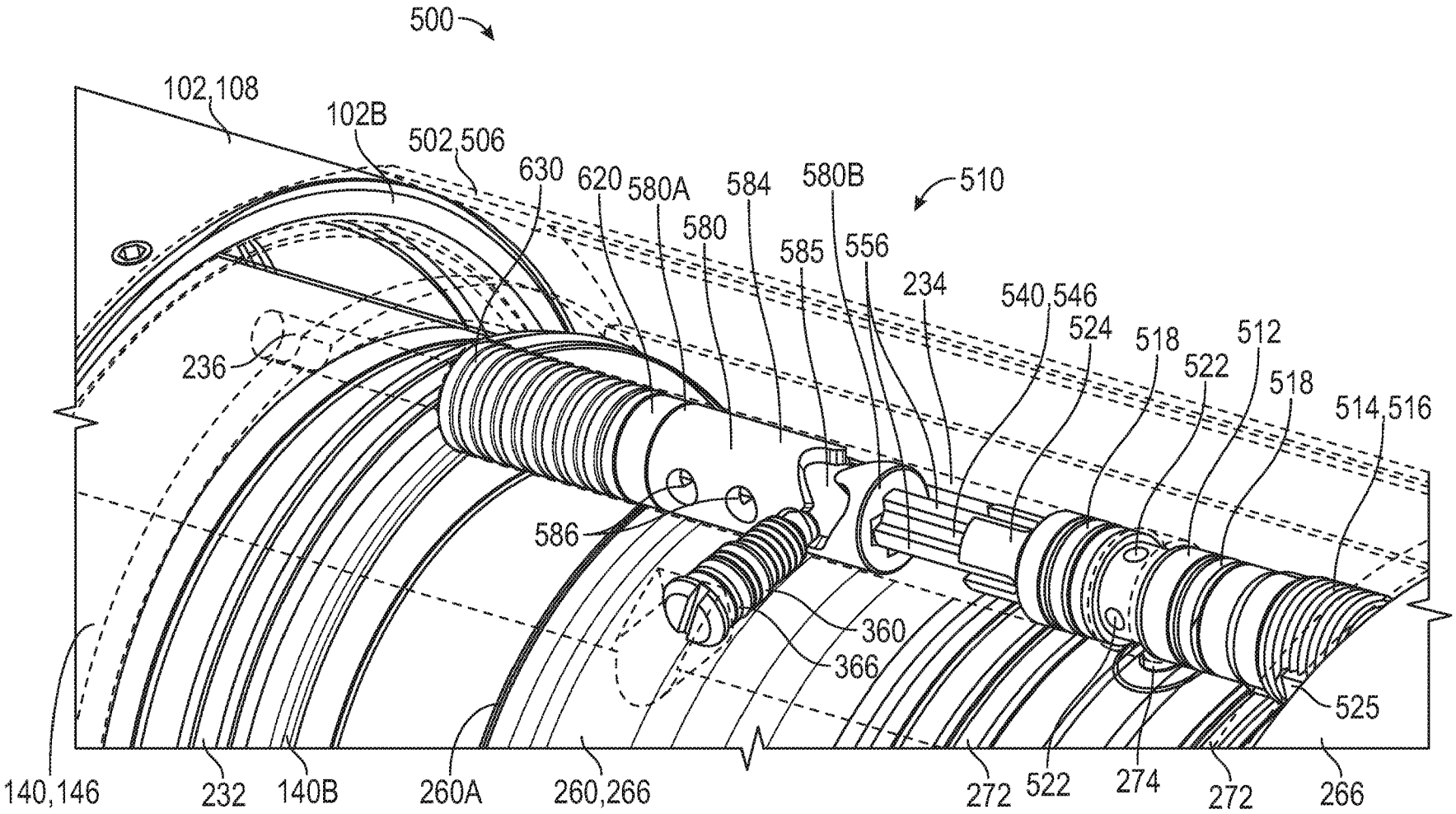
FIG. 14 is a perspective view of the poppet valve assembly of FIG. 12 disposed in the first position.
Figure 15:
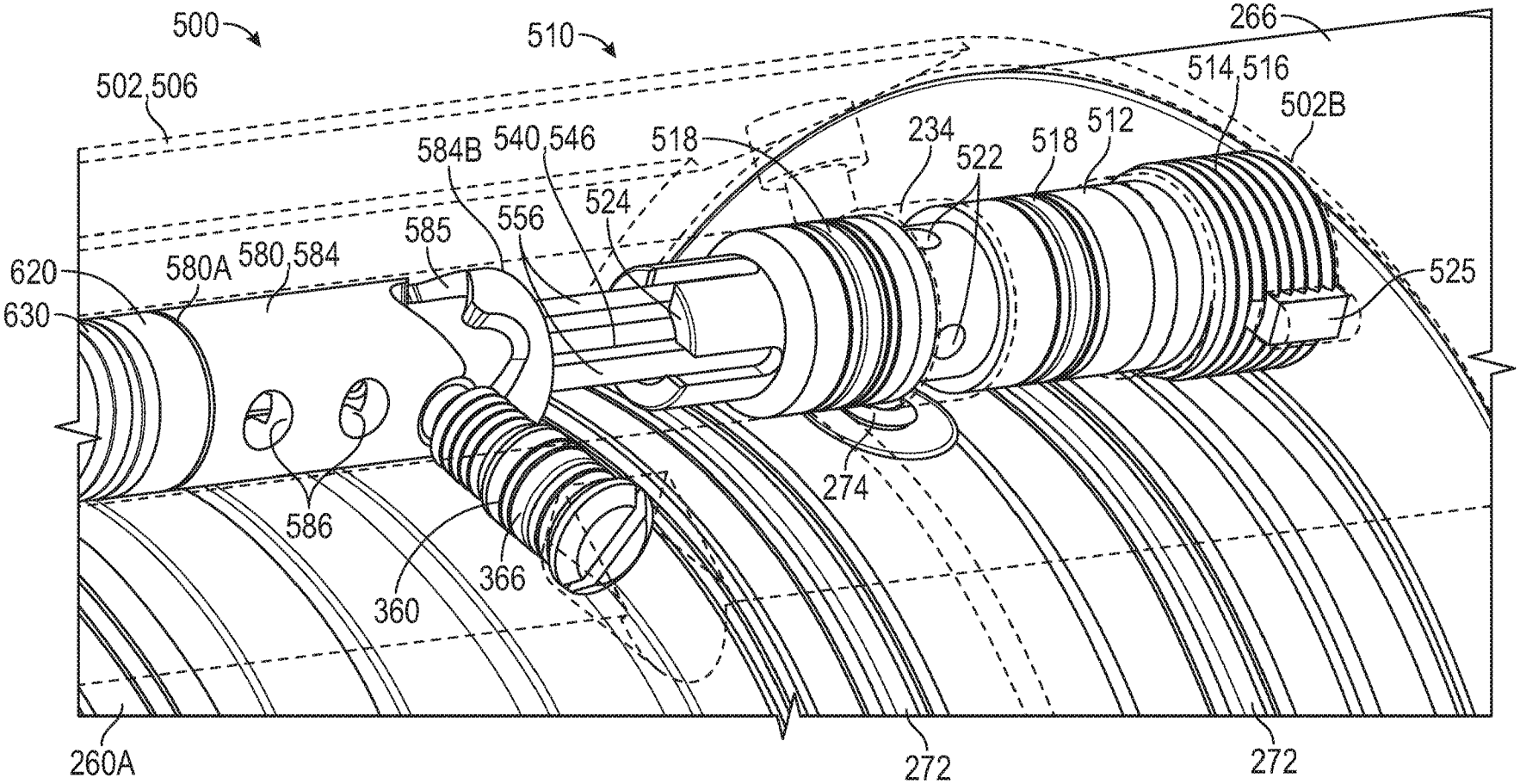
FIG. 15 is a perspective view of the poppet valve assembly of FIG. 12 disposed in the first position.
Figure 17:
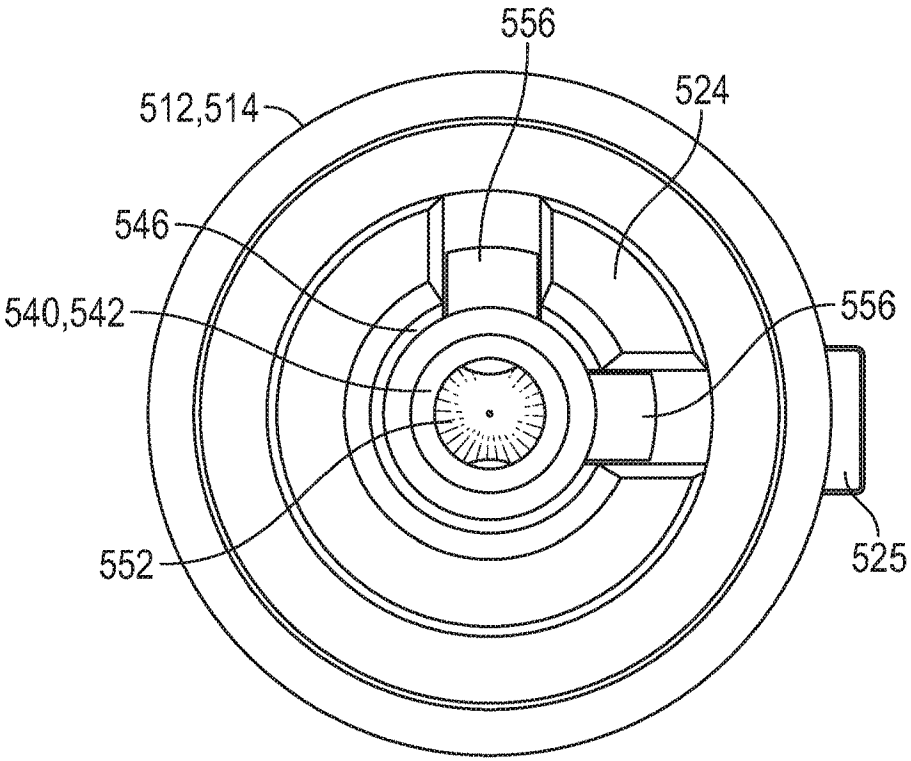
FIG. 17 is an end view of an embodiment of a piston or valve stem of the poppet valve assembly of FIG. 12 in accordance with principles disclosed herein.
Figure 16:
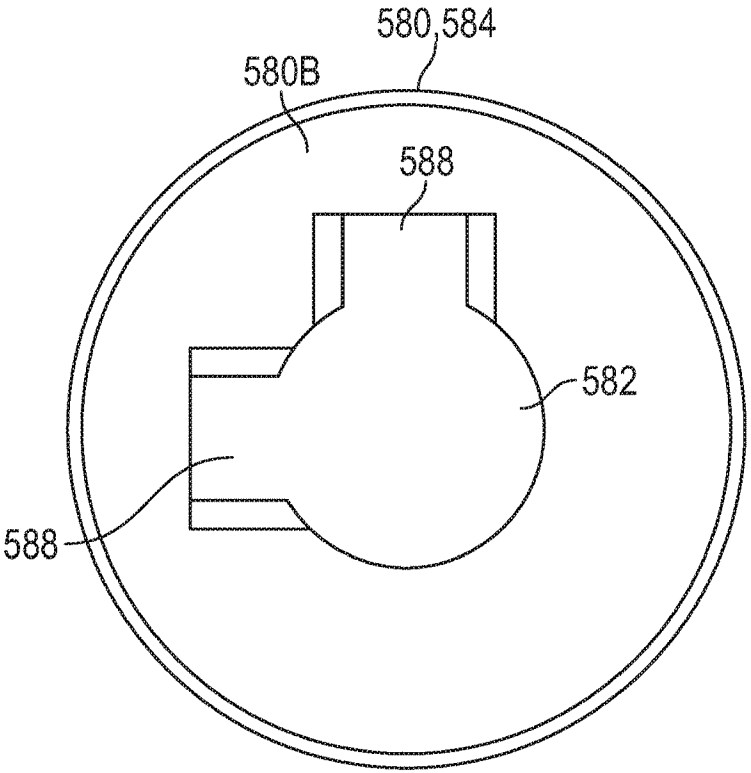
FIG. 16 is an end view of an embodiment of an indexing sleeve of the poppet valve assembly of FIG. 12 in accordance with principles disclosed herein.

As shown particularly in FIGS. 14 and 16, indexing sleeve 580 also includes a plurality of circumferentially spaced and axially extending slots or keyways 588 formed in the inner surface of central passage 582. Keyways 588 extend into indexing sleeve 580 from lower end 580B and include the same circumferential spacing as the circumferential spacing of keys 556 of indexing piston 540. In other words, when keys 556 of indexing piston 540 are angularly aligned with keyways 588 of indexing sleeve 580, keys 556 may be inserted into and received in keyways 588, thereby allowing indexing piston 540 to travel axially upwards in poppet valve chamber 234 relative to indexing sleeve 580. However, when keys 556 of indexing piston 540 are angularly spaced or misaligned with keyways 588 of indexing sleeve 580, the upper end of each key 556 contacts the lower end 580B of indexing sleeve 580, restricting upward travel of indexing piston 580 through poppet valve chamber 234 relative to indexing sleeve 580. In this embodiment, retainer 620 comprises an annular member that is disposed directly adjacent or contacts the upper end 580A of indexing sleeve 580. Biasing member 630 extends axially between and engages the upper terminal end 237 of poppet valve chamber 234 and an upper end of retainer 620. In this arrangement, biasing member 630 applies an axial biasing force against retainer 620 and indexing sleeve 580 in the direction of piston housing 512.

Referring to FIGS. 1, 9, and 12-22, having described the structure of the embodiments of well system 10 and toe valve 500 shown in FIGS. 12-20, an embodiment of toe valve 500's operation will now be described. Similar to the operation of toe valve 100 shown in FIGS. 2-11, following the installation and cementing of casing 18, hydraulic pressure may be applied to the central passage 28 of liner 18 via one or more pumps disposed at the surface 5 such that a predetermined test pressure is applied to toe valve 500. As shown particularly in FIGS. 12-17, prior to the application of hydraulic pressure at the surface 5, sliding sleeve 180 is disposed in lower position 181, rupture disk 274 seals poppet valve chamber 234 from central passage 28 of casing 18, and indexing pin 360 is disposed in first position 361A (shown in FIG. 9) within the J-slot 585 of indexing sleeve 580, which, in conjunction with the biasing force applied against the upper end 580A of indexing sleeve 580, maintains seal assemblies 548A, 548B of indexing piston 540 in sealing engagement with the inner surface of the central passage 520 of piston housing 512. Additionally, keys 556 of indexing piston 540 are angularly offset from keyways 588 of indexing sleeve 580, with the upper end of each key 556 in contact with the lower end 580B of indexing sleeve 580.

Following the application of hydraulic pressure in central passage 28 from the surface 5, fluid pressure in toe valve 500 is increased until the test pressure is applied to toe valve 500. In some embodiments, the test pressure comprises a fluid pressure greater than both a hydrostatic pressure in passage 28 and a fluid pressure for hydraulically fracturing formation 3. In other embodiments, the test pressure is substantially equal to the fluid pressure for hydraulically fracturing the formation 3. Once the test pressure is applied to toe valve 500 from the application of hydraulic pressure at the surface 5, at least one of rupture disks 274 rupture, establishing fluid communication between central passage 520 of piston housing 512 and the bore 262 of lower sub 260 via ports 522 of piston housing 512. Thus, following the rupture of at least one of rupture disks 274, central passage 520 of piston housing 512 is pressurized to the test pressure, thereby applying an axially upwards directed pressure force against indexing piston 540.

Figure 18:
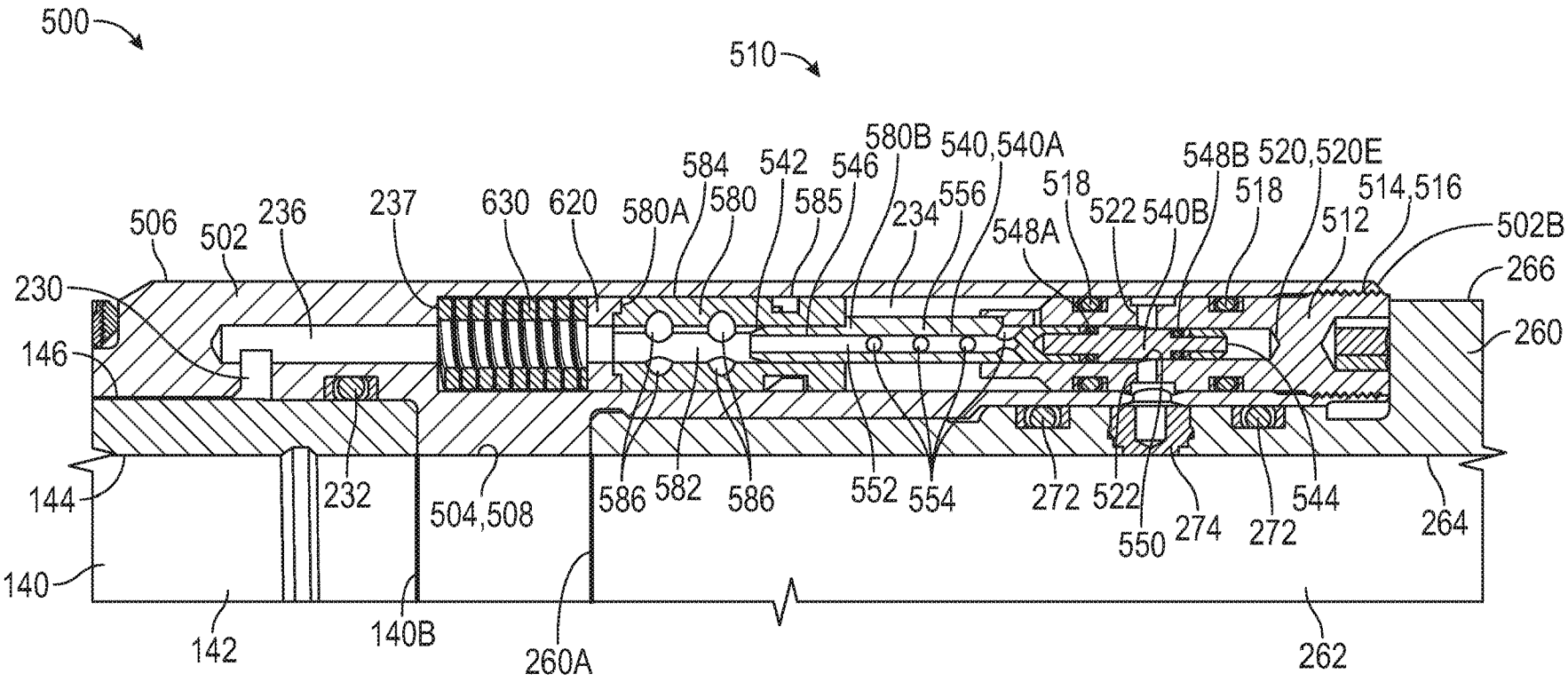
FIG. 18 is a side cross-sectional view of the poppet valve assembly of FIG. 12 disposed in a second position.
Figure 19:
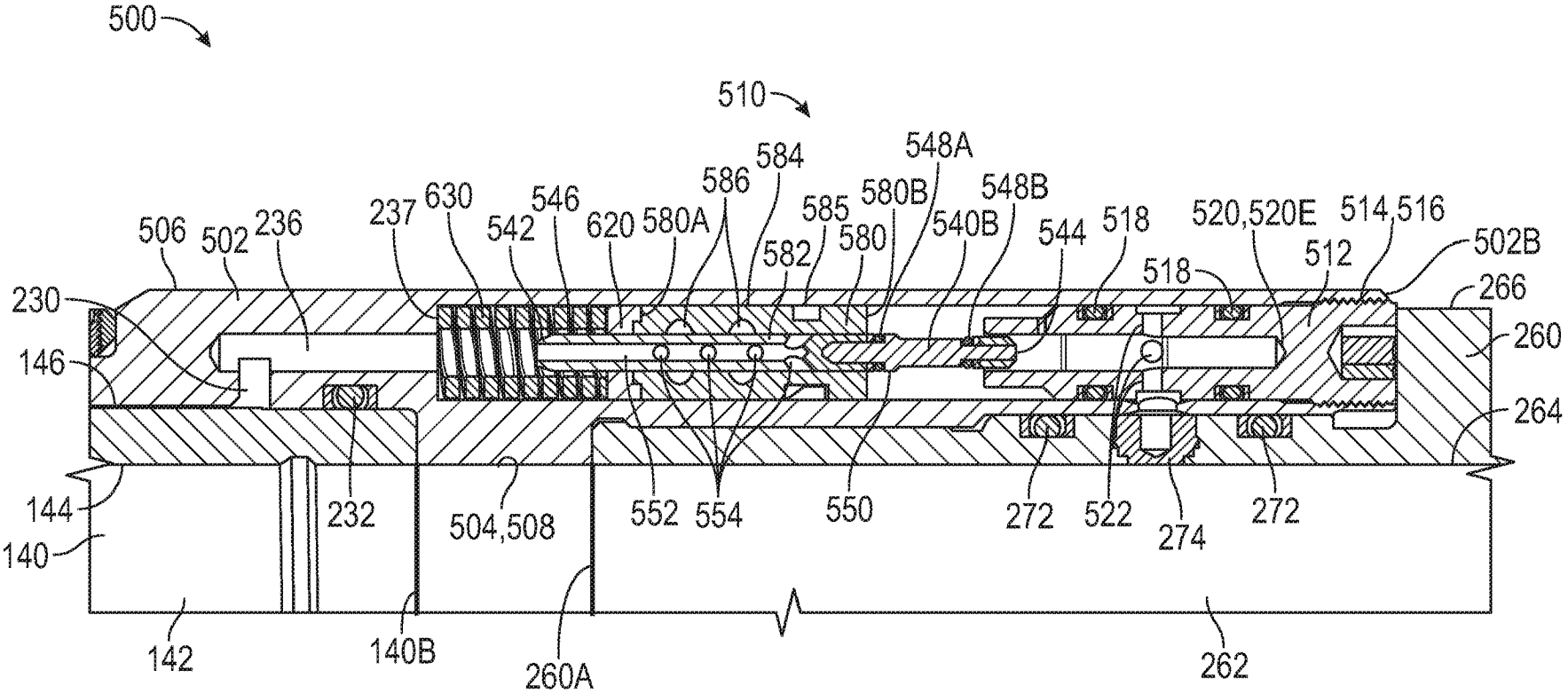
FIG. 19 is a side cross-sectional view of the poppet valve assembly of FIG. 12 disposed in a third position.
Figure 20:
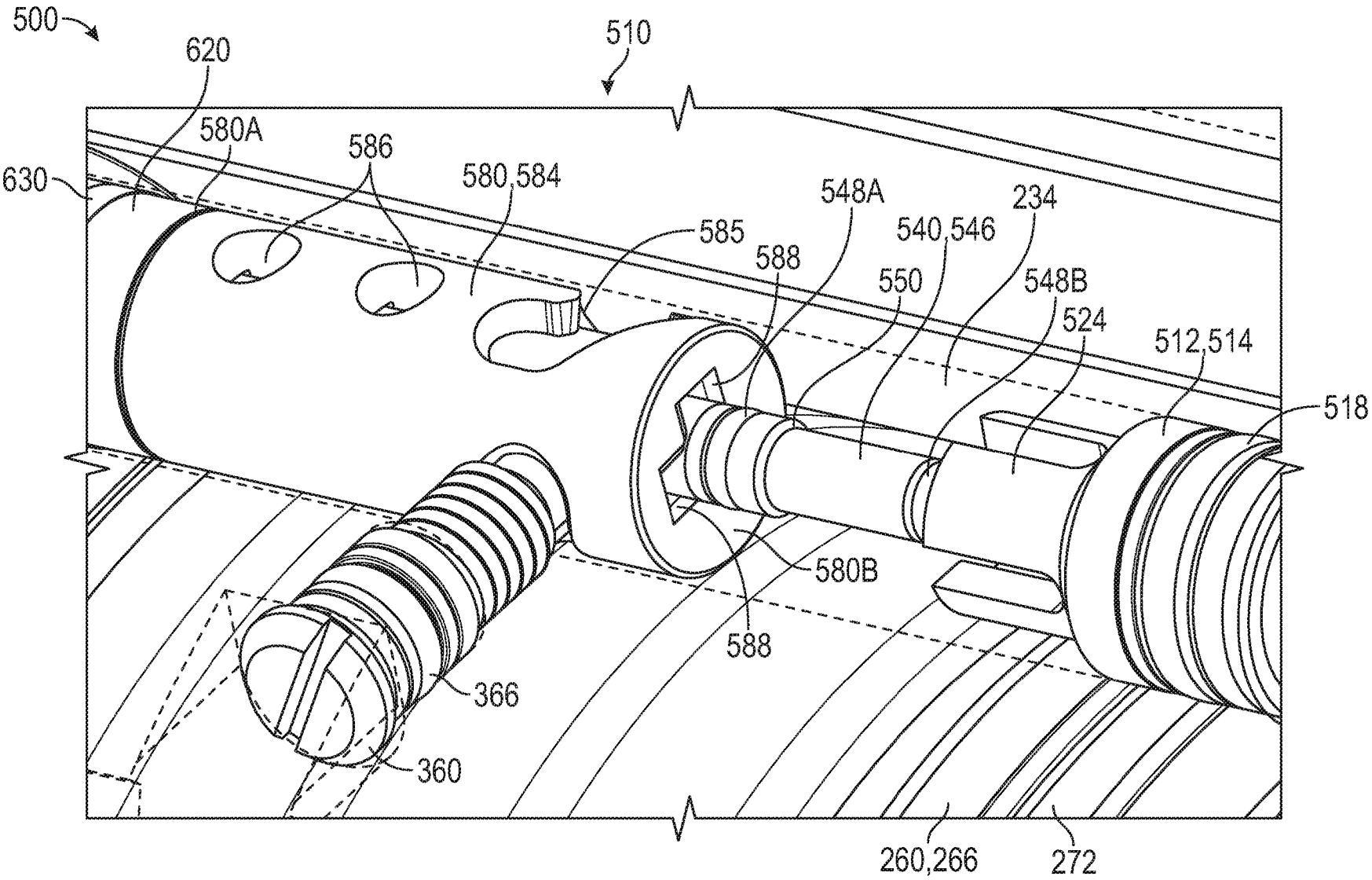
FIG. 20 is a perspective view of the poppet valve assembly of FIG. 12 disposed in the third position.
Figure 21:
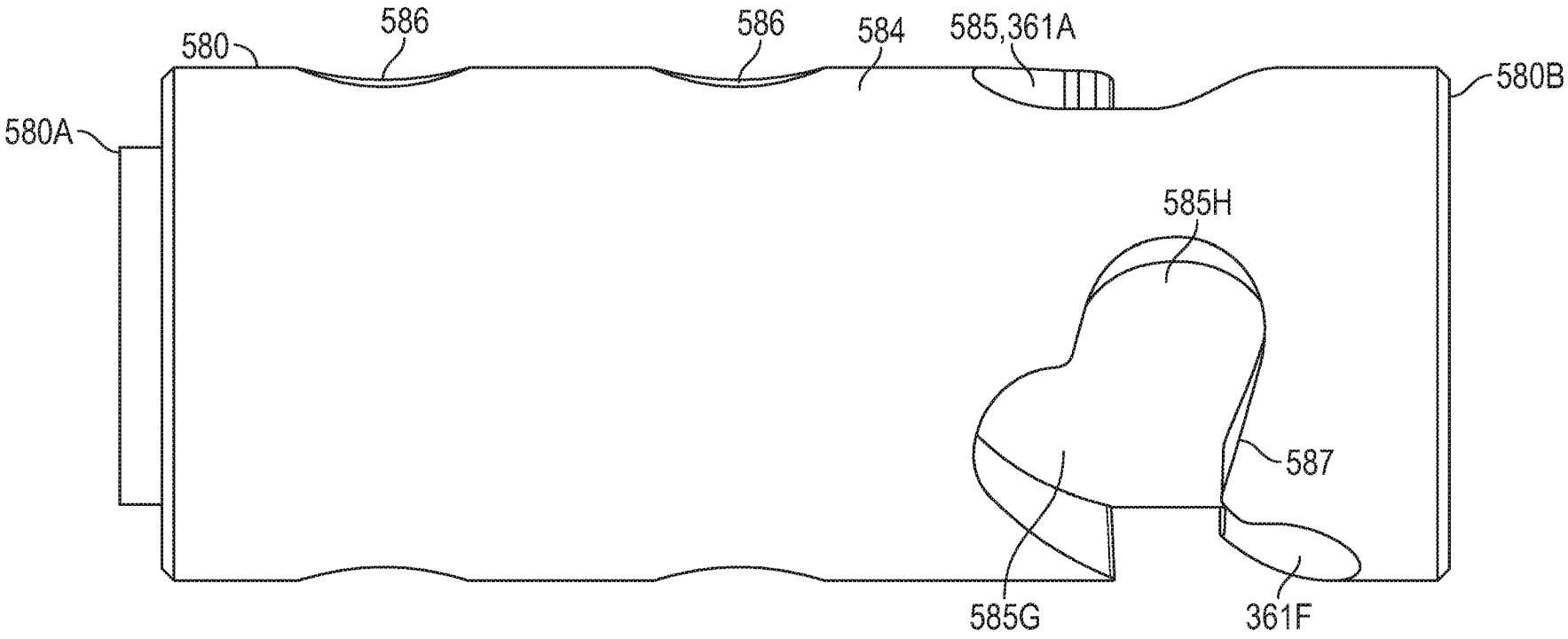
FIG. 21 is a top view of the indexing sleeve of FIG. 16.
Figure 22:
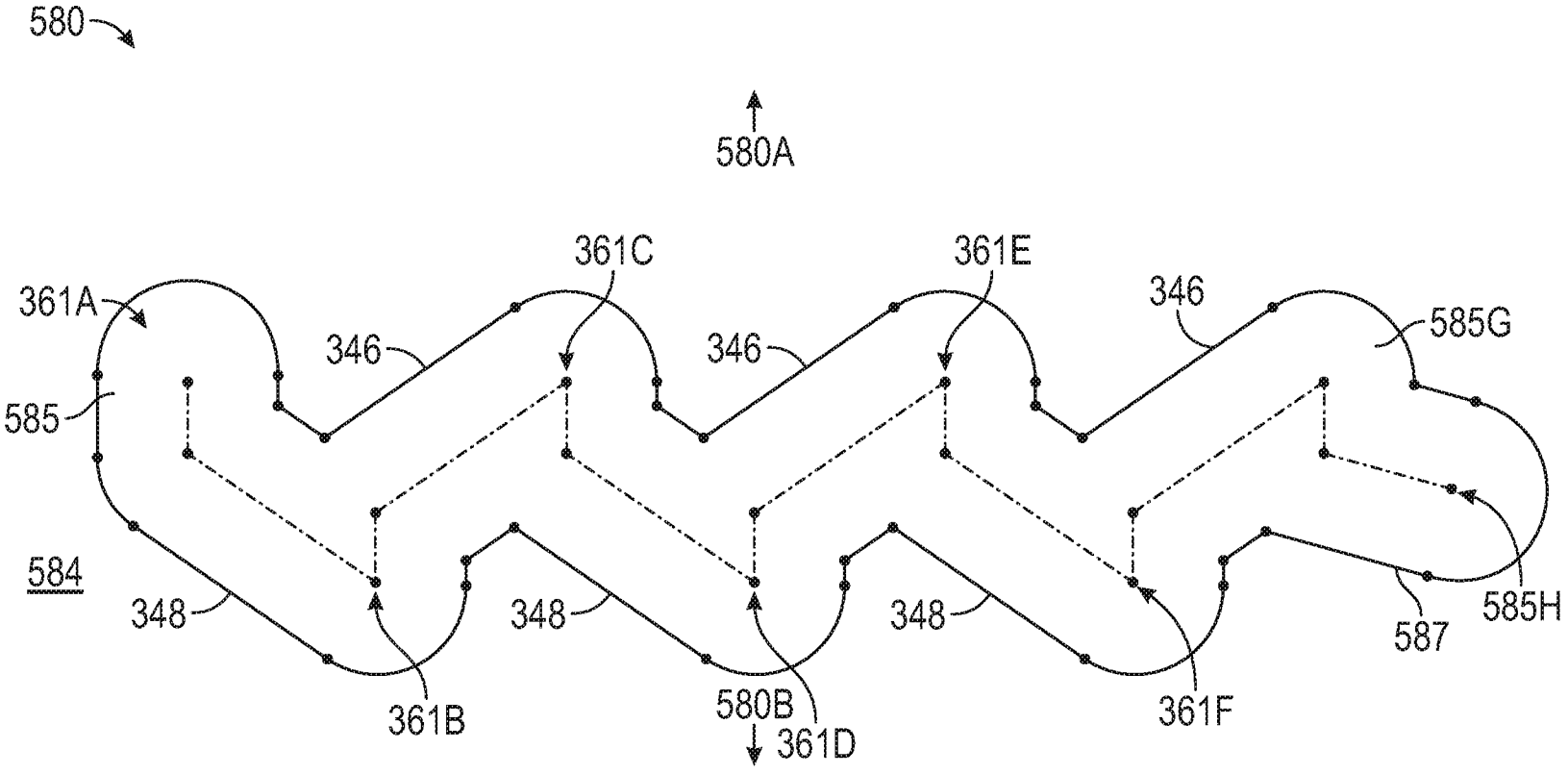
FIG. 22 is a schematic view of the indexing sleeve of FIG. 16.
Figure 23:
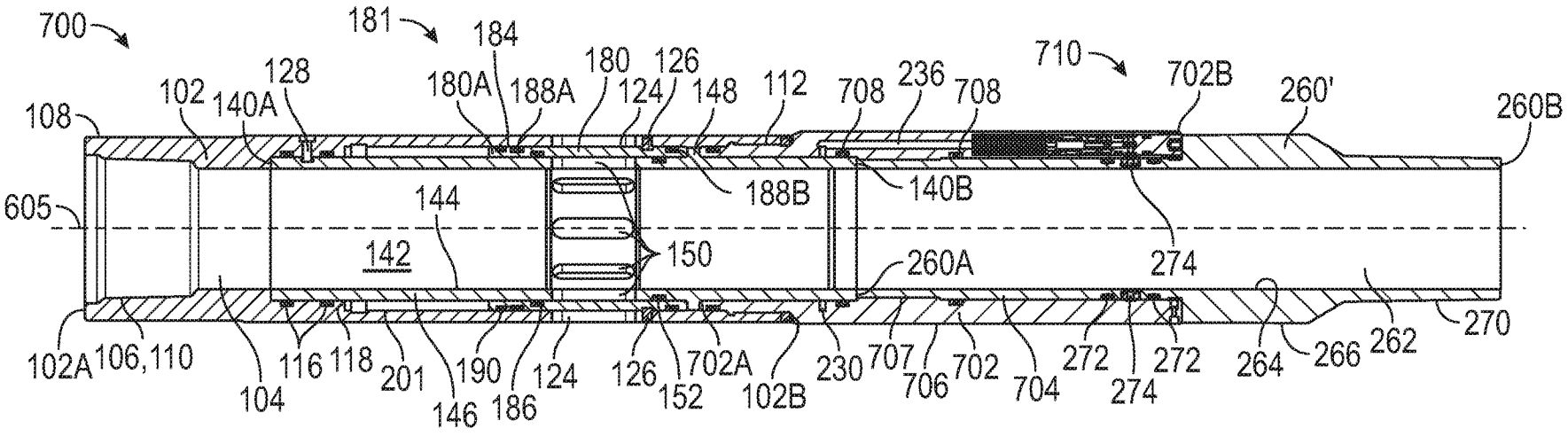
FIG. 23 is a side cross-sectional view of another embodiment of a sliding sleeve valve or toe valve of the well system of FIG. 1 in accordance with principles disclosed herein.
Figure 24:
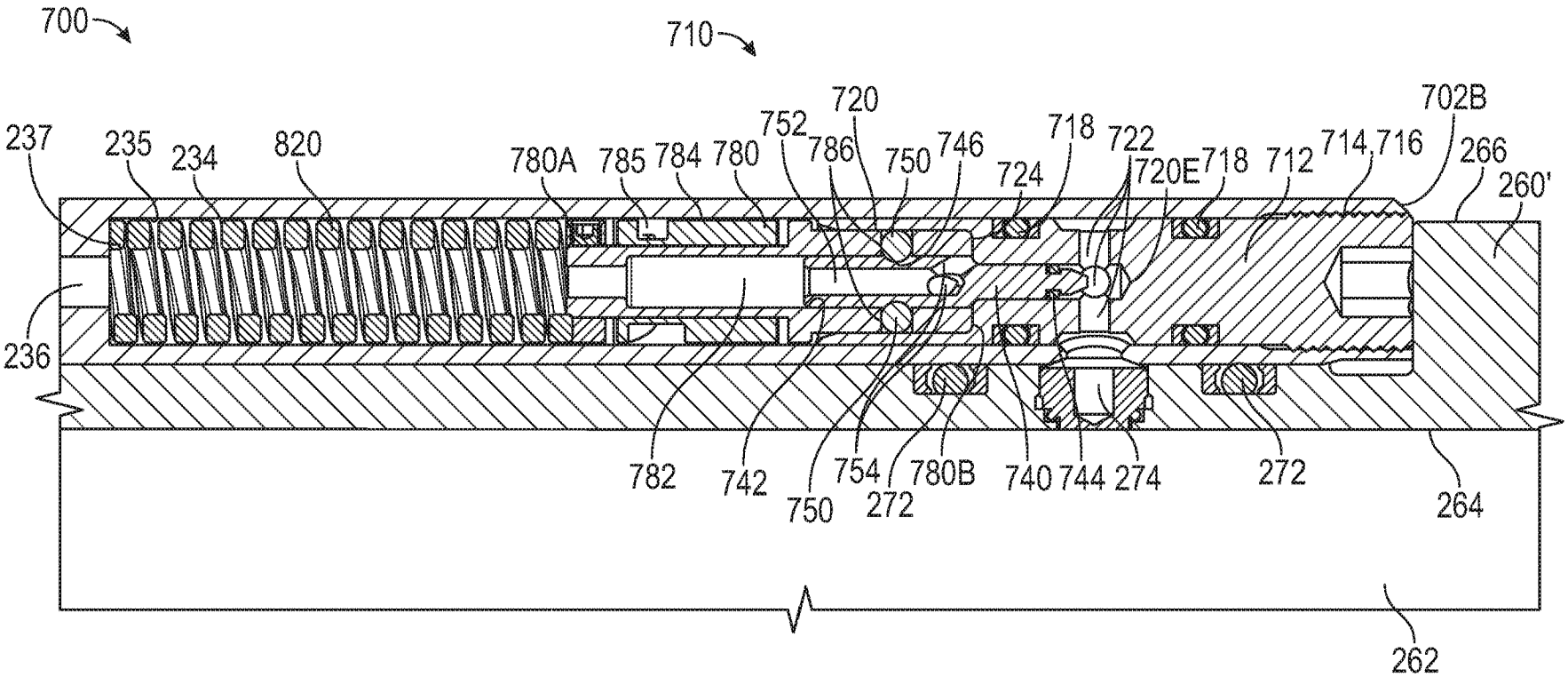
FIG. 24 is a side cross-sectional view of an embodiment of a poppet valve assembly of the toe valve of FIG. 23 disposed in a first position in accordance with principles disclosed herein.
Figure 25:
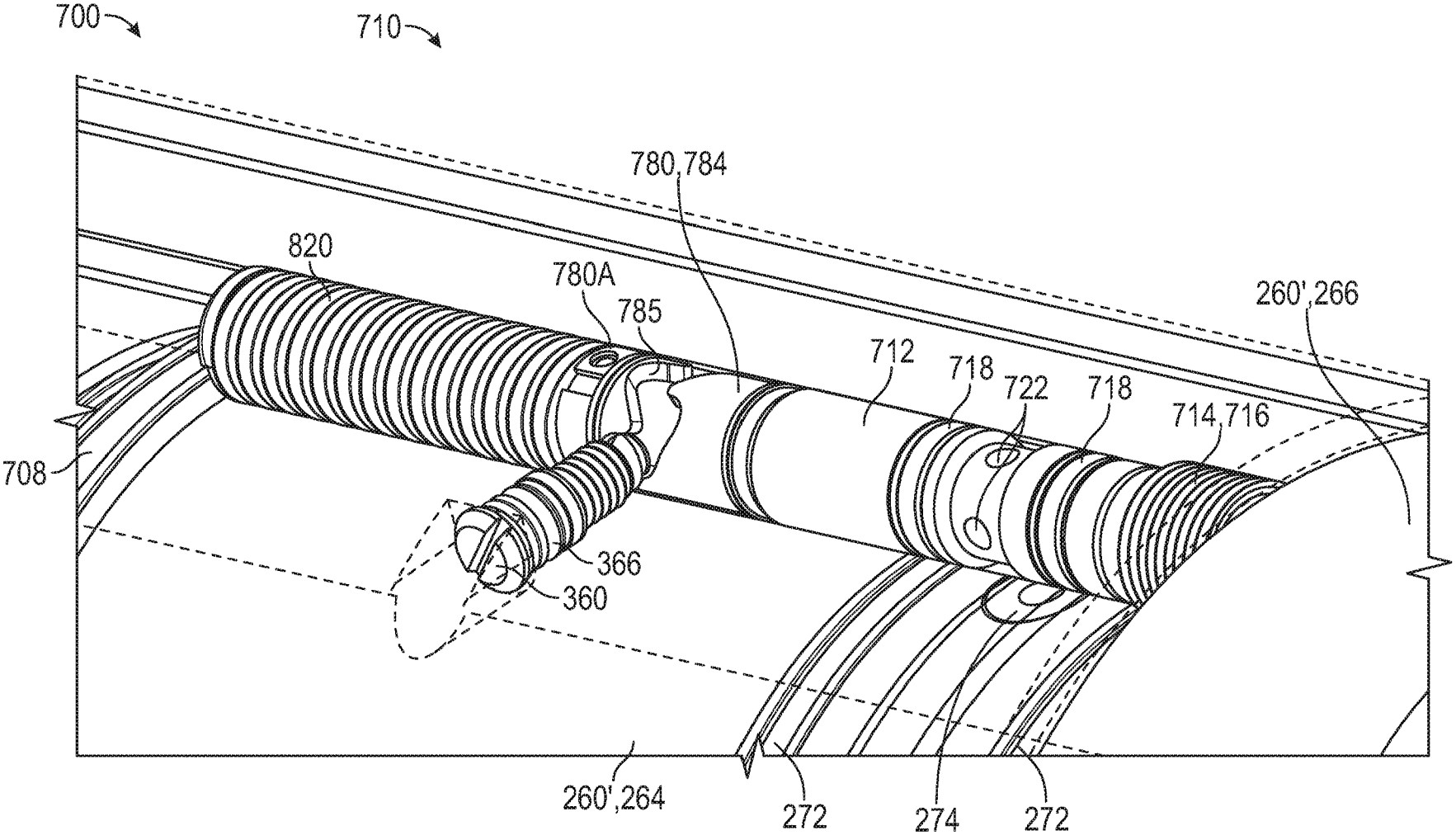
FIG. 25 is a perspective view of the poppet valve assembly of FIG. 24 disposed in the first position.

As shown particularly in FIG. 18, the pressure force applied against indexing piston 540 causes indexing piston 540 and indexing sleeve 580 to travel upwards through poppet valve chamber 234 in concert, compressing biasing member 630. Additionally, as indexing piston 540 moves axially towards the upper end 237 of poppet valve chamber 234, indexing sleeve 580 rotates about indexing piston 540 in response to engagement between first lower shoulder 348 of J-slot 585 and indexing pin 360 until indexing pin 360 comes to rest in second position 361B that is axially and circumferentially spaced from first position 361A. With indexing pin 360 disposed in the second position 361B, seal assemblies 548A, 548B of indexing piston 540 remain in sealing engagement with the inner surface of central passage 520, which, in conjunction with the sealing engagement of seal assemblies 518 against the inner surface of poppet valve chamber 234, restrict fluid communication between bore 262 of lower sub 260 and poppet valve passage 236. Additionally, with indexing pin 360 disposed in second position 361B, keys 556 of indexing pin 540 remain angularly misaligned from keyways 588 of indexing sleeve 580, thereby maintaining engagement between the upper end of each key 556 and the lower end 580B of indexing sleeve 580. Casing 18 may be held at the test pressure with pin 360 disposed in second position 361B for as long necessary to complete the pressure test of casing 18 and cement 24. Thus, similar to the operation of toe valve 100, toe valve 500 allows nearly unlimited flexibility regarding the duration of the first pressure test.

Once the first pressure test has been completed, the hydraulic pressure applied to central passage 28 of casing from the surface 5 may be released or vented, causing pressure in poppet valve chamber 234 to decrease below the predetermined test pressure. As pressure in poppet valve chamber 234 decreases below the predetermined test pressure, biasing member 630 forces indexing sleeve 580 and indexing piston 540 downwards through poppet valve chamber 234 until indexing sleeve 580 and indexing piston 540 return to an axial position proximal their original axial positions (shown in FIG. 13). As indexing piston 540 and indexing sleeve 580 travel downwards through poppet valve chamber 234, indexing pin 360 travels through J-slot 585 and physically engages first upper shoulder 346, causing indexing sleeve 580 to rotate relative to indexing piston 540. Indexing pin 360 continues to travel through J-slot 585 until it comes to rest in third position 361C. With indexing pin 360 retained in the third position 361C, seal assemblies 548A, 548B of indexing piston 540 continue to seal against the inner surface of central passage 520, restricting fluid communication between bore 262 of lower sub 260 and poppet valve passage 236.

Following the transition of indexing pin 360 into the third position 361C, additional pressure tests may be conducted in a manner similar to the operation of toe valve 100 to cycle indexing pin 360 between the fourth, fifth, sixth, and seventh positions 361D, 361E, 361F, and 585G, where seventh position 585G of J-slot 585 is axially aligned with positions 361C and 361E. As indexing pin 360 is cycled between positions 361D, 361E, 361F, and 585G, seal assemblies 548A, 548B of indexing piston 540 continue to seal against the inner surface of central passage 520, restricting fluid communication between bore 262 of lower sub 260 and poppet valve passage 236. However, once indexing pin 360 is located in the seventh position 585G (shown in FIGS. 21, 22), toe valve 500 may be pressurized at the test pressure to transition indexing pin 360 into the eighth position 585H (shown in FIGS. 21, 22) and permit fluid communication between bore 262 of lower sub 260 and poppet valve passage 236, which thereby actuates sliding sleeve 180 from the lower position 181 to the upper position 183. Thus, unlike poppet assembly 300, which actuates sliding sleeve 180 from the lower position 181 to the upper position 183 in response to releasing pressure in poppet valve chamber 234, poppet valve assembly 510 is configured to actuate sliding sleeve 180 from the lower position 181 to the upper position 183 in response to pressurizing poppet valve chamber 234 to a pressure greater than hydrostatic pressure.

Particularly, as the test pressure is communicated to poppet valve chamber 234, indexing pin 360 contacts a lower shoulder 587 of J-slot 585, rotating indexing sleeve 580 relative to indexing piston 540 until indexing pin 360 is disposed in eighth position 585H. Once indexing pin 360 is positioned in eighth position 585H, keyways 588 of indexing sleeve 580 angularly align with keys 556 of indexing piston 540, allowing keys 556 to be inserted into keyways 588. Additionally, the pressure force applied against shoulder 550 of indexing piston 540 from the pressurized central passage 520 of piston housing 512 forces indexing piston 540 axially upwards through poppet valve chamber 234, as shown particularly in FIG. 19. As indexing piston 540 travels upwards through poppet valve chamber 234, seal assemblies 548A, 548B come out of sealing engagement with the inner surface of central passage 520. With seal assemblies 548A, 548B no longer in sealing engagement with the inner surface of central passage 520, fluid from bore 262 of lower sub 260 is permitted to flow into central passage 552 of indexing piston 540 via ports 554, and into poppet valve passage 236 via the central passage 582 of indexing sleeve 580 and ports 586. With fluid communication now established between poppet valve passage 236 and the bore 262 of lower sub 260, hydraulic pressure within bore 262 of lower sub 260 may be communicated to the lower atmospheric chamber 203, causing sliding sleeve 180 to actuate from the lower position 181 to the upper position 183 and establish fluid communication between toe valve 500 and the environment surrounding toe valve 500.

Referring to FIGS. 23-30, another embodiment of a testable sliding sleeve or toe valve 700 of the well system 10 of FIG. 1 is shown in FIGS. 23-30. Toe valve 500 has features in common with toe valve 100 shown in FIGS. 2-11 and toe valve 500 shown in FIGS. 12-17, and shared features are labeled similarly. In some embodiments, toe valve 700 may be included in or formed with casing 18 proximal the lower end 20 thereof. In the embodiment of FIGS. 23-30, toe valve 700 has a central or longitudinal axis 705 and generally includes upper sub 102, inner mandrel 140, sliding sleeve 180, an actuator or poppet valve housing 702 that receives an actuator or poppet valve assembly 710 therein, and a lower sub 260'. Lower sub 260' is similar to the lower sub 260 of toe valve 500 except that the upper end 260A of lower sub 260' extends to the lower end 140B of mandrel 140.

In this embodiment, poppet valve housing 702 of toe valve 700 is generally cylindrical and includes a first or upper end 702A, a second or lower end 702B, a central bore or passage defined by a generally cylindrical inner surface 704 extending between ends 702A, 702B, and a generally cylindrical outer surface 706 also extending between ends 702A, 702B. Poppet valve housing 702 is generally similar in configuration to the poppet valve housing 502 of toe valve 500 shown in FIGS. 12-17. However, the inner surface 704 of poppet valve housing 702 includes a pair of annular seals 708 disposed at each end of a releasable or threaded connection 707 formed between poppet valve housing 702 and lower sub 260'. In this configuration, fluid pressure in bore 262 of lower sub 260' may not be communicated to the annular interface positioned between poppet valve chamber 234 and the outer surface 266 of lower sub 260'. In this manner, elevated fluid pressure in bore 262 of lower sub 260' is inhibited from buckling or otherwise deforming poppet valve chamber 234 in a way that may jeopardize the performance of poppet valve assembly 710.

As shown particularly in FIGS. 24-30, poppet valve assembly 710 of toe valve 700 is received in the poppet valve chamber 234 of poppet valve housing 702, and is configured to control the actuation of sliding sleeve 180 between the lower position 181 and upper position 183. Particularly, poppet valve assembly 710 is configured to allow for the performance of multiple pressure tests of casing 18 and cement 24 before sliding sleeve 180 is actuated from the lower position 181 to the upper position 183. In this embodiment, poppet valve assembly 710 generally includes a piston housing 712, a piston 740 slidably received in piston housing 712, an indexing sleeve 780, and a biasing member 820.

In this embodiment, piston housing 712 comprises a generally cylindrical outer surface 714 including a releasable or threaded connector 716 located at a lower end of piston housing 712. Additionally, outer surface 714 includes a pair of axially spaced annular seal assemblies 718 disposed thereon, where seal assemblies 718 sealingly engage the inner surface 235 of poppet valve chamber 234. In this embodiment, piston housing 712 includes a generally cylindrical central passage or chamber 720 that extends axially into piston housing 712 from an upper end of piston housing 712 and terminates within piston housing 712 at a terminal end 720E. A plurality of circumferentially spaced ports 722 extend radially between outer surface 714 and central passage 720, providing fluid communication between poppet valve chamber 234 and central passage 720. Additionally, central passage 720 of piston housing 712 includes an annular shoulder 724. A lower seal assembly 718 of the pair of seal assemblies 718 of piston housing 712 restricts fluid communication between central passage 720 and the environment surrounding toe valve 700. Relative rotation between piston housing 712 and poppet valve housing 702 is restricted, such as through the use, in some embodiments, of an anti-rotation key placed between piston housing 712 and poppet valve housing 702.

The piston 740 of poppet valve assembly 710 includes a generally cylindrical outer surface 742 extending between opposing ends of piston 740. In this embodiment, the outer surface 742 of piston 740 includes an annular seal assembly 744 positioned at a lower end of piston 740 and an annular groove 746 positioned between an upper end of piston 740 and seal assembly 744. Seal assembly 744 of piston 740 sealingly engages the inner surface of the central passage 720 of piston housing 712. In the position of piston 740 shown in FIG. 24, groove 746 of piston 740 at least partially receives a plurality of circumferentially spaced, spherically shaped detents 750. In this embodiment, piston 740 also includes a central passage 752 that extends into piston 740 from an upper end thereof to a terminal end formed therein. A plurality of circumferentially spaced ports 754 extend radially between the outer surface 742 of piston 740 and central passage 752. However, in the position of piston 740 shown in FIG. 24, sealing engagement between seal assembly 744 and the inner surface of the central passage 720 of piston housing 712 restricts fluid flow between ports 722 of piston housing 712 and ports 754 of piston 740.

The indexing sleeve 780 of poppet valve assembly 710 is generally cylindrical and includes a first or upper end 780A, a second or lower end 780B, a central bore or passage 782 that receives piston 740, and a generally cylindrical outer surface 784 extending between ends 780A and 780B. The outer surface 784 of indexing sleeve 780 includes a J-slot 785 which interfaces with indexing pin 360 in a manner similar to the indexing sleeve 580 of the poppet valve assembly 510 shown in FIGS. 13-22. Particularly, in this embodiment, indexing sleeve 780 comprises a radially inner sleeve in which central passage 782 is formed and a radially outer sleeve upon which J-slot 785 is formed, the outer sleeve of indexing sleeve 780 being axially locked to the inner sleeve of indexing sleeve 780; however, in other embodiments, indexing sleeve 780 may comprise a single monolithically formed member. As will be discussed further herein, J-slot 785 shares features in common with J-slot 585 of poppet valve assembly 510, including positions 361A-361F and 585G; however, indexing sleeve 780 includes an eighth position 785H rather than the eighth position 585H of J-slot 585.

In this embodiment, indexing sleeve 580 also includes a plurality of circumferentially spaced receptacles 786 each receiving a corresponding detent 750. As will be described further herein, when detents 750 are positioned in the central passage 720 of piston housing 712, detents 750 are each forced radially inwards by the inner surface of central passage 720 into the groove 746 of piston 740 (shown in FIG. 24), thereby restricting relative axial movement between indexing sleeve 780 and piston 740. The biasing member 820 of poppet valve assembly 710 extends axially between and engages the upper terminal end 237 of poppet valve chamber 234 and the upper end 780A of indexing sleeve 780. In this arrangement, biasing member 820 applies an axial biasing force against indexing sleeve 780 in the direction of piston housing 712, with physical engagement between the lower end 780B of indexing sleeve 780 and the annular shoulder 724 of piston housing 712 limiting the downward travel of indexing sleeve 780 through the central passage 720 of piston housing 712.

Referring to FIGS. 1, 11, and 23-30, having described the structure of the embodiments of toe valve 700 shown in FIGS. 23-30, an embodiment of toe valve 700's operation will now be described. Similar to the operation of toe valve 500 shown in FIGS. 12-22, following the installation and cementing of casing 18, hydraulic pressure may be applied to the central passage 28 of liner 18 via one or more pumps disposed at the surface 5 such that a predetermined test pressure is applied to toe valve 700. As shown particularly in FIGS. 23-25, prior to the application of hydraulic pressure at the surface 5, sliding sleeve 180 is disposed in lower position 181, rupture disk 274 seals poppet valve chamber 234 from central passage 28 of casing 18, and indexing pin 360 is disposed in first position 361A (shown in FIG. 30) within the J-slot 785 of indexing sleeve 580, which, in conjunction with the biasing force applied against the upper end 780A of indexing sleeve 580 by biasing member 820, maintains seal assembly 744 of piston 740 in sealing engagement with the inner surface of the central passage 720 of piston housing 712.

Following the application of hydraulic pressure in central passage 28 from the surface 5, fluid pressure in toe valve 700 is increased until the test pressure is applied to toe valve 700. In some embodiments, the test pressure comprises a fluid pressure greater than both a hydrostatic pressure in passage 28 and a fluid pressure for hydraulically fracturing formation 3. In other embodiments, the test pressure is substantially equal to the fluid pressure for hydraulically fracturing the formation 3. Once the test pressure is applied to toe valve 700 from the application of hydraulic pressure at the surface 5, at least one of the rupture disks 274 rupture, establishing fluid communication between a portion of central passage 720 of piston housing 712 and the bore 262 of lower sub 260 via ports 722 of piston housing 712. Thus, following the rupture of at least one of rupture disks 274, central passage 720 of piston housing 712 is pressurized to the test pressure, thereby applying an axially upwards directed pressure force against piston 740 due to the sealing engagement between seal assembly 744 and the inner surface of central passage 720.

Figure 26:
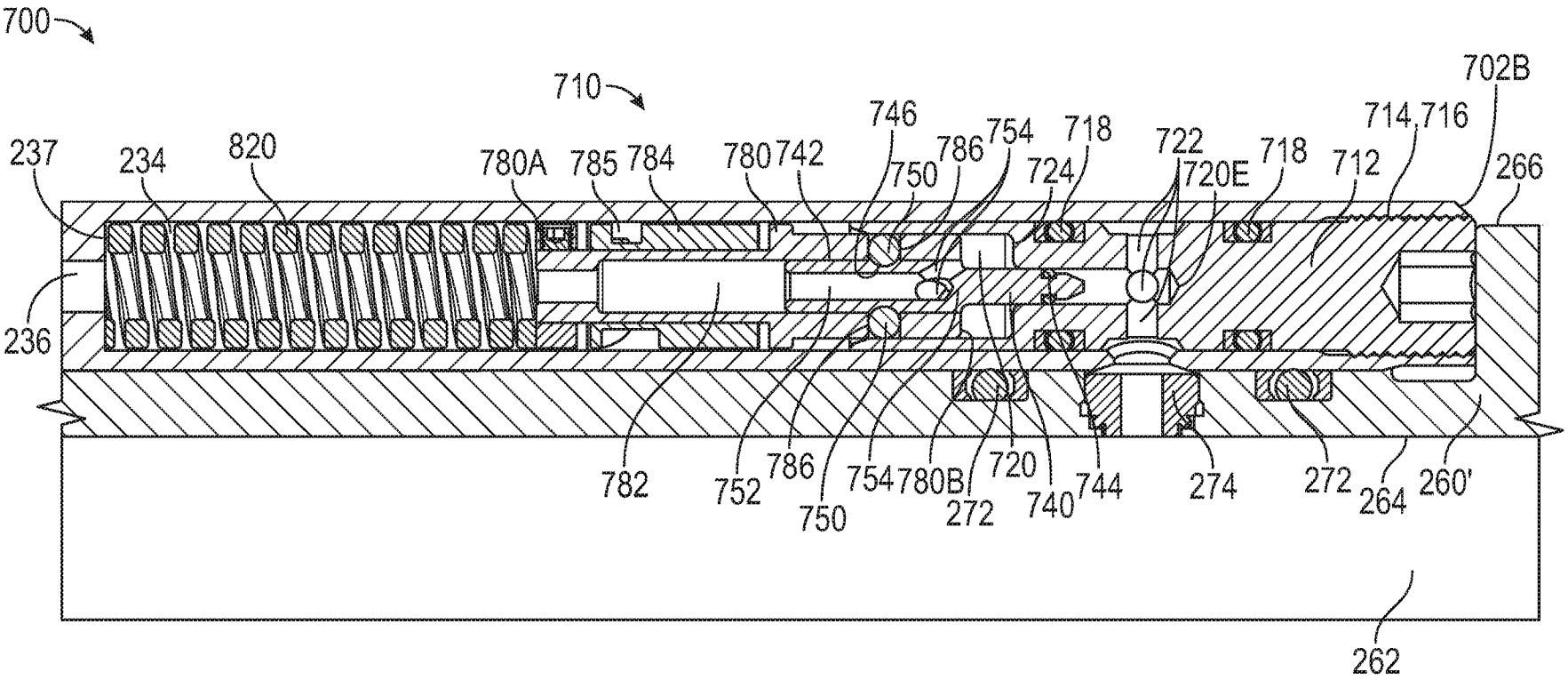
FIG. 26 is a side cross-sectional view of the poppet valve assembly of FIG. 24 disposed in a second position.
Figure 27:
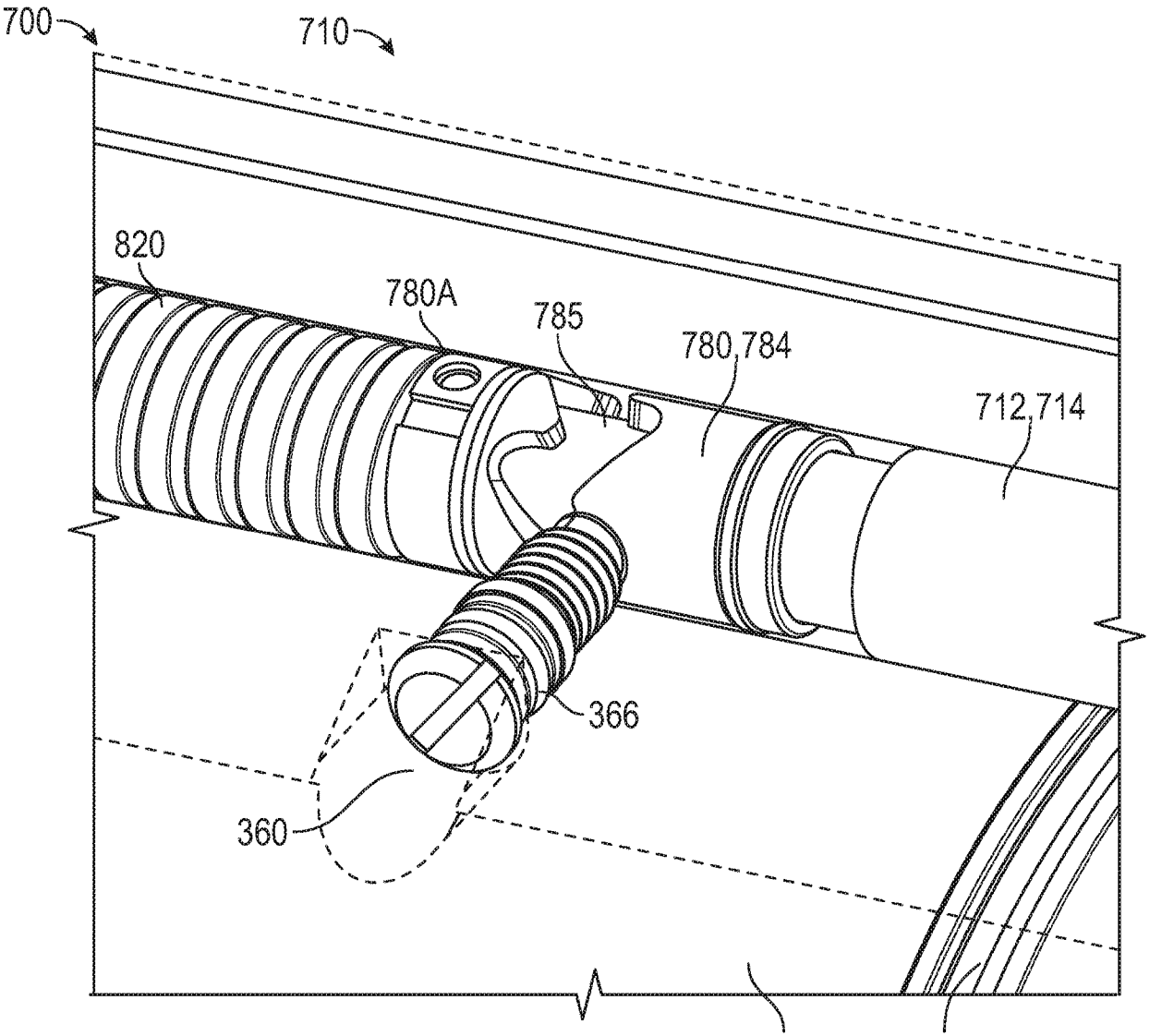
FIG. 27 is a perspective view of the poppet valve assembly of FIG. 24 disposed in the second position.
Figure 28:
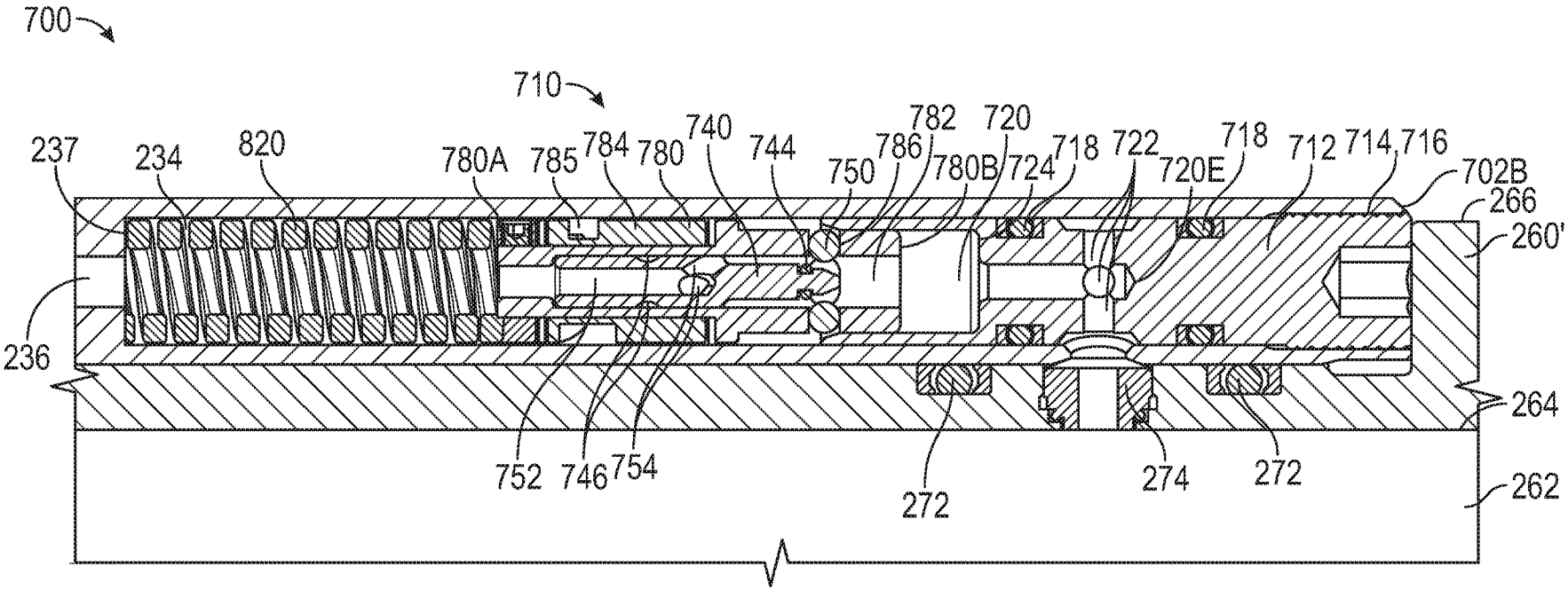
FIG. 28 is a side cross-sectional view of the poppet valve assembly of FIG. 24 disposed in a third position.
Figure 29:
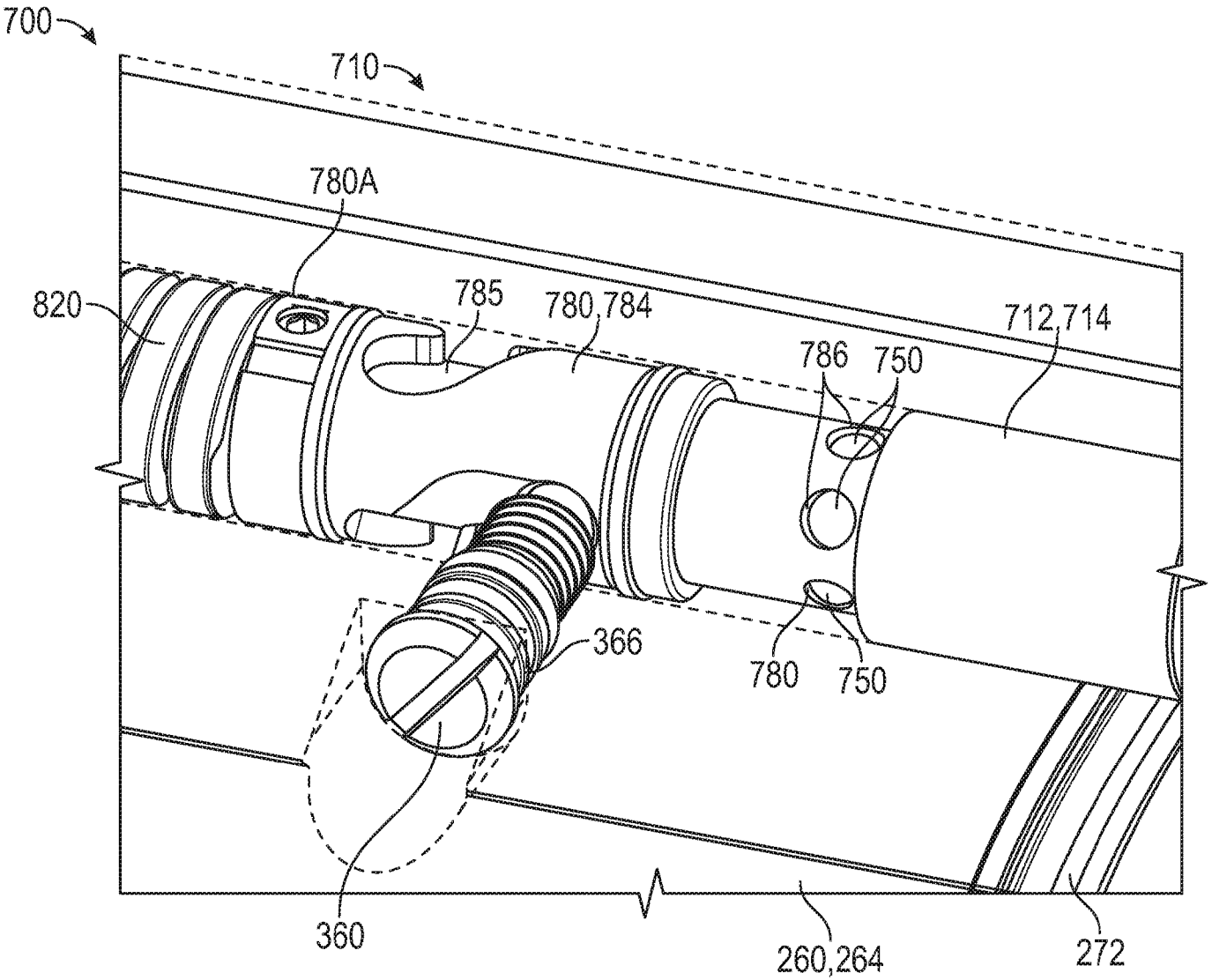
FIG. 29 is a perspective view of the poppet valve assembly of FIG. 24 disposed in the third position.
Figure 30:
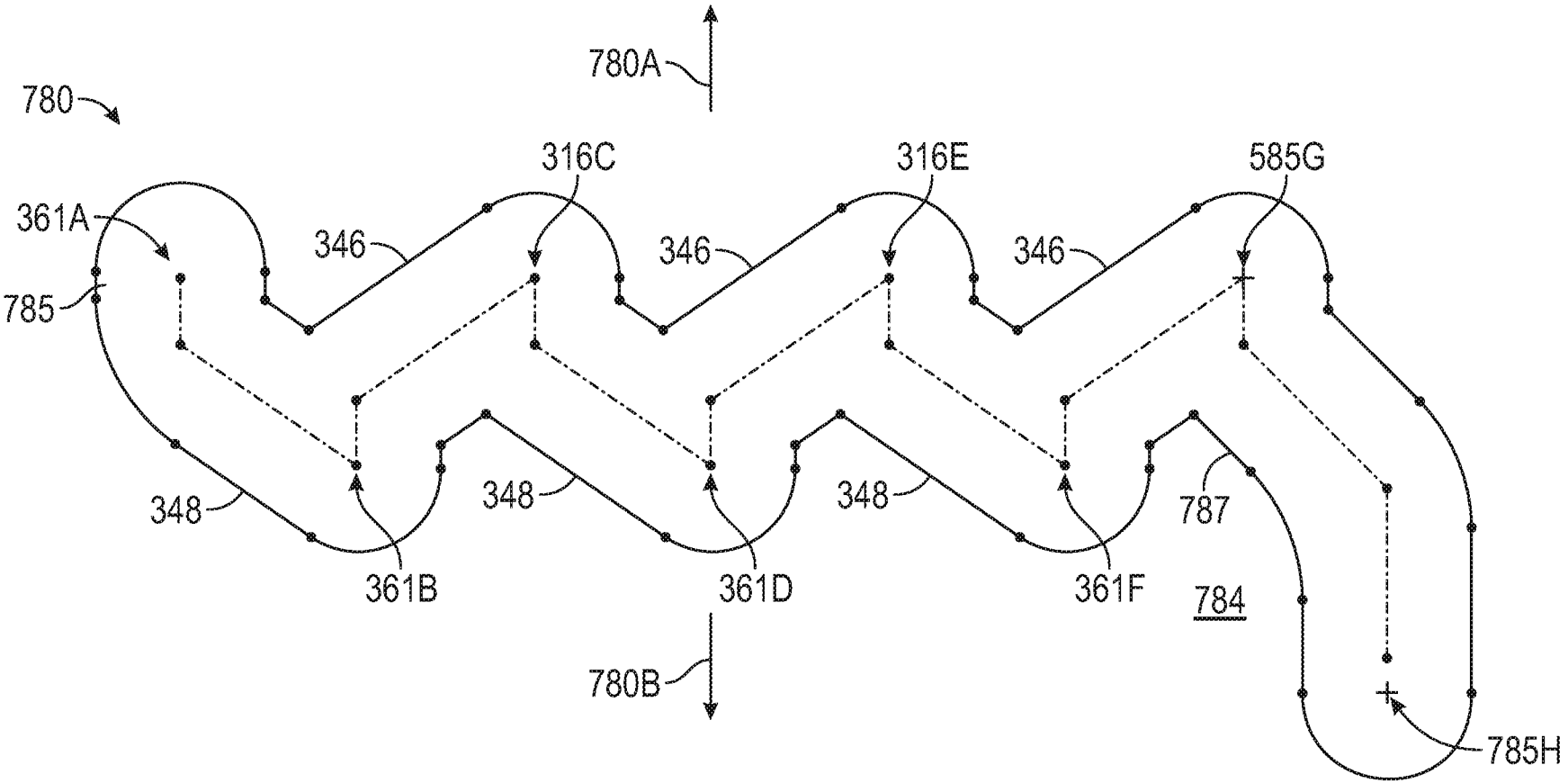
FIG. 30 is a schematic view of an embodiment of an indexing sleeve of the poppet valve assembly of FIG. 24 in accordance with principles disclosed herein.

As shown particularly in FIGS. 26, 27, and 30, the pressure force applied against piston 740 causes piston 740 and indexing sleeve 780 to travel upwards through poppet valve chamber 234 in concert, thereby compressing biasing member 820. Additionally, as piston 740 moves axially towards the upper end 237 of poppet valve chamber 234, indexing sleeve 780 rotates about piston 740 in response to engagement between first lower shoulder 348 of J-slot 785 and indexing pin 360 until indexing pin 360 comes to rest in the second position 361B that is axially and circumferentially spaced from the first position 361A. With indexing pin 360 disposed in the second position 361B, seal assembly 744 of piston 740 remains in sealing engagement with the inner surface of the central passage 720 of piston housing 712, which, in conjunction with the sealing engagement of seal assemblies 718 against the inner surface of poppet valve chamber 234, restrict fluid communication between bore 262 of lower sub 260 and poppet valve passage 236. Casing 18 may be held at the test pressure with pin 360 disposed in second position 361B for as long necessary to complete the pressure test of casing 18 and cement 24. Thus, similar to the operation of toe valves 100, 500, toe valve 700 allows nearly unlimited flexibility regarding the duration of the first pressure test.

Once the first pressure test has been completed, the hydraulic pressure applied to central passage 28 of casing from the surface 5 may be released or vented, causing pressure in poppet valve chamber 234 to decrease below the predetermined test pressure. As pressure in poppet valve chamber 234 decreases below the predetermined test pressure, biasing member 820 forces indexing sleeve 780 and piston 740 downwards through poppet valve chamber 234 until indexing sleeve 780 and piston 740 return to an axial position proximal their original axial positions (shown in FIGS. 24, 25). As piston 740 and indexing sleeve 780 travel downwards through poppet valve chamber 234, indexing pin 360 travels through J-slot 785 and physically engages first upper shoulder 346, causing indexing sleeve 780 to rotate relative to piston 740. Indexing pin 360 continues to travel through J-slot 785 until it comes to rest in the third position 361C.

Following the transition of indexing pin 360 into the third position 361C, additional pressure tests may be conducted in a manner similar to the operation of toe valves 100, 500 to cycle indexing pin 360 between the fourth, fifth, sixth, and seventh positions 361D, 361E, 361F, and 585G. As indexing pin 360 is cycled between positions 361D, 361E, 361F, and 585G, seal assembly 744 of piston 740 continue to seal against the inner surface of central passage 720, restricting fluid communication between bore 262 of lower sub 260 and poppet valve passage 236. However, once indexing pin 360 is located in the seventh position 585G, toe valve 700 may be pressurized at the test pressure to transition indexing pin 360 into the eighth position 785H (shown in FIG. 300) to permit fluid communication between bore 262 of lower sub 260 and poppet valve passage 236, which thereby actuates sliding sleeve 180 from the lower position 181 to the upper position 183. Thus, like the poppet valve assembly 510 shown in FIGS. 13-22, poppet valve assembly 510 is configured to actuate sliding sleeve 180 from the lower position 181 to the upper position 183 in response to pressurizing poppet valve chamber 234 to a pressure greater than hydrostatic pressure.

Particularly, as the test pressure is communicated to poppet valve chamber 234, indexing pin 360 contacts a lower shoulder 787 of J-slot 785, rotating indexing sleeve 780 relative to piston 740 until indexing pin 360 is disposed in eighth position 785H. Once indexing pin 360 is positioned in eighth position 785H, detents 750 are permitted to exit the upper end of piston housing 712 (shown in FIG. 28). No longer restricted by the inner surface of the central passage 720 of piston housing 712, the pressure force applied to the lower end of piston 740 forces detents 750 radially outwards and out of annular groove 746 of piston 740, thereby permitting relative axial movement between piston 740 and indexing sleeve 780. With detents 750 each disposed in the radially outwards position, the pressure force acting against the lower end of piston 740 forces piston 740 upwards through the central passage 782 of indexing sleeve 780, causing seal assembly 744 to disengage from the inner surface of the central passage 720 of piston housing 712 and thereby permit fluid flow between central passage 720 and poppet valve passage 236 of lower sub 260' via the ports 754 of piston 740. With fluid communication now established between poppet valve passage 236 and the bore 262 of lower sub 260, hydraulic pressure within bore 262 of lower sub 260 may be communicated to the lower atmospheric chamber 203, causing sliding sleeve 180 to actuate from the lower position 181 to the upper position 183 and establish fluid communication between toe valve 700 and the environment surrounding toe valve 700.

In some applications, it may be advantageous in the formation of hydraulic fractures in formation 3 to actuate sliding sleeve 180 from the lower position 181 to the upper position 183 in response to pressurizing poppet valve chamber 234 to a pressure greater than hydrostatic pressure. Particularly, actuating the sliding sleeve 180 from the lower position 181 to the upper position 183 in response to pressurizing poppet valve chamber 234 to a pressure greater than hydrostatic pressure immediately exposes the formation 3 to fracturing pressure given that hydraulic pressure in toe valve 700 does not need to be increased to fracturing pressure following the opening of sliding sleeve 180. The impulse created from the near-instantaneous exposure of fracturing pressure to formation 3 may, in at least some applications, be conducive for forming productive fractures within formation 3.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A sliding sleeve valve for use in a borehole, comprising:

an outer housing comprising a radial housing slot and a central passage;

a sliding sleeve slidably disposed in the outer housing, the sliding sleeve comprising a first position that restricts fluid communication between the central passage of the outer housing and the housing slot and a second position, axially spaced from the first position, that permits fluid communication between the central passage of the outer housing and the housing slot;

an actuator housing coupled to the outer housing, wherein the actuator housing comprises an actuator chamber defined by an inner surface extending around a central axis of the actuator chamber, and wherein the actuator chamber is disposed radially between an inner cylindrical surface and an outer cylindrical surface of the actuator housing; and an actuator assembly disposed in the actuator chamber, wherein the actuator assembly is configured to control movement of the sliding sleeve between the first and second positions in response to fluidically pressurizing the central passage of the outer housing.

2. The sliding sleeve valve of claim 1, wherein the actuator assembly comprises:

an indexing sleeve including a J-slot formed on an outer surface thereof; and an indexing pin coupled to the actuator housing, wherein an inner end of the indexing pin is received in the J-slot of the indexing sleeve.

3. The sliding sleeve valve of claim 2, wherein the actuator assembly is configured to cycle the indexing pin between a plurality of positions along the J-slot of the indexing sleeve in response to pressurizing a central passage of the outer housing.

4. The sliding sleeve valve of claim 3, wherein the sliding sleeve is maintained in the first position as the indexing pin is cycled between the plurality of positions along the J-slot of the indexing sleeve.

5. The sliding sleeve valve of claim 1, wherein the actuator assembly comprises a poppet valve assembly.

6. The sliding sleeve valve of claim 1, wherein the actuator chamber is radially offset from a central axis of the actuator housing.

7. The sliding sleeve valve of claim 1, wherein a diameter of the actuation chamber is less than a diameter of a central passage of the actuator housing, wherein the central passage is defined by the inner surface of the actuator housing.

8. The sliding sleeve valve of claim 1, further comprising a rupture disk disposed in the inner surface of the actuator housing, wherein the rupture disk is configured to rupture at a predetermined pressure to provide fluid communication between a central passage of the actuator housing and the actuator chamber.

9. The sliding sleeve valve of claim 1, further comprising:

a mandrel disposed in and coupled with the outer housing, the mandrel comprising a cylindrical outer surface;

an annular first atmospheric chamber extending between an annular outer housing seal that is disposed radially between the outer housing and the mandrel, and a first sleeve seal that is disposed radially between the sleeve and the outer housing; and an annular second atmospheric chamber extending between a second sleeve seal that is disposed radially between the sleeve and the outer housing, and an actuator seal that is disposed radially between the actuator housing and the mandrel.

10. The sliding sleeve valve of claim 9, further comprising:

an actuation passage extending between the actuation chamber and the second atmospheric chamber;

wherein the actuator assembly is configured to selectively permit fluid communication between the actuation chamber and the actuation passage.

11. The sliding sleeve valve of claim 10, wherein, in response to fluid communication between the actuation chamber and the actuation passage, the actuation assembly is configured to displace the sliding sleeve from the first position to the second position.

12. The sliding sleeve valve of claim 1, further comprising:

a piston housing comprising a central passage that is disposed in the actuator chamber;

a piston slidably disposed in the actuator chamber and configured to selectably seal against an inner surface of the passage of the piston housing;

an indexing sleeve including a J-slot formed on an outer surface thereof, wherein the indexing sleeve comprises a central passage configured to receive the piston; and an indexing pin coupled to the actuator housing, wherein an inner end of the indexing pin is received in the J-slot of the indexing sleeve.

13. The sliding sleeve valve of claim 12, wherein:

an end of the piston is received in the passage of the piston housing when the sliding sleeve is in the first position; and the end of the piston is spaced from the passage of the piston housing when the sliding sleeve is in the second position.

14. The sliding sleeve valve of claim 12, further comprising:

a plurality of circumferentially spaced detents positioned radially between the piston and the indexing sleeve;

wherein the detents are configured to restrict relative axial movement between the piston and the indexing sleeve when the indexing sleeve is in a first axial position relative to the piston housing;

wherein the detents are configured to permit relative axial movement between the piston and the indexing sleeve when the indexing sleeve is in a second axial position relative to the piston housing that is spaced from the first axial position.

15. The sliding sleeve valve of claim 1, wherein the actuator chamber is positioned within a wall of the actuator housing and wherein relative movement between the actuator housing and the outer housing is restricted.

16. A sliding sleeve valve for use in a borehole, comprising:

an outer housing comprising a radial housing slot and a central passage;

a sliding sleeve slidably disposed in the outer housing, the sliding sleeve comprising a first position that restricts fluid communication between the central passage of the outer housing and the housing slot and a second position, axially spaced from the first position, that permits fluid communication between the central passage of the outer housing and the housing slot;

an actuator housing coupled to the outer housing, wherein the actuator housing comprises a cylindrical actuator chamber that is radially offset from the central axis of the actuator housing; and an actuator assembly disposed in the actuator chamber, wherein the actuator assembly is configured to control the movement of the sliding sleeve between the first and second positions in response to fluidically pressurizing the central passage of the outer housing.

17. The sliding sleeve valve of claim 16, further comprising:

a piston housing comprising a central passage that is disposed in the actuator chamber;

a piston slidably disposed in the actuator chamber and configured to selectably seal against an inner surface of the passage of the piston housing; and a rupture disk configured to provide fluid communication between a central passage of the actuator housing and the actuator chamber in response to the application of a predetermined pressure to a central passage of the actuator housing.

18. The sliding sleeve valve of claim 17, wherein:

an end of the piston is received in the passage of the piston housing when the sliding sleeve is in the first position; and the end of the piston is spaced from the passage of the piston housing when the sliding sleeve is in the second position.

19. The sliding sleeve valve of claim 17, further comprising:

an indexing sleeve including a J-slot formed on an outer surface thereof, wherein the indexing sleeve comprises a central passage configured to receive the piston; and an indexing pin coupled to the actuator housing, wherein an inner end of the indexing pin is received in the J-slot of the indexing sleeve.

20. The sliding sleeve valve of claim 19, further comprising:

a plurality of circumferentially spaced detents positioned radially between the piston and the indexing sleeve;

wherein the detents are configured to restrict relative axial movement between the piston and the indexing sleeve when the indexing sleeve is in a first axial position relative to the piston housing;

wherein the detents are configured to permit relative axial movement between the piston and the indexing sleeve when the indexing sleeve is in a second axial position relative to the piston housing that is spaced from the first axial position.

21. The sliding sleeve valve of claim 19, wherein the actuator assembly is configured to cycle the indexing pin between a plurality of positions along the J-slot of the indexing sleeve in response to pressurizing a central passage of the outer housing.

22. The sliding sleeve valve of claim 16, further comprising:

a valve stem disposed in the actuator chamber and configured to selectably seal against a valve seat on a first end of the actuator chamber;

a rupture disk configured to provide fluid communication between a central passage of the actuator housing and the actuator chamber in response to the application of a predetermined pressure to a central passage of the actuator housing.

a piston disposed about the valve stem;

an indexing sleeve including a J-slot formed on an outer surface thereof, wherein the indexing sleeve is disposed about and locked to the piston whereby axial movement of the indexing sleeve relative to the indexing pin is prevented; and an indexing pin coupled to the actuator housing, wherein an inner end of the indexing pin is received in the J-slot of the indexing sleeve.

23. The sliding sleeve valve of claim 22, further comprising:

a first biasing member extending between the first end of the actuator chamber and a first end of the piston, wherein the first biasing member is configured to bias the piston and the valve stem towards a second end of the actuation chamber;

a second biasing member extending between the first end of the piston and a shoulder on the valve stem, wherein the second biasing member is configured to bias the valve stem towards the valve seat.

24. The sliding sleeve valve of claim 22, wherein, in response to rupturing of the rupture disk, the piston is configured to displace the indexing pin from a first position in the J-slot to a second position in the J-slot that is circumferentially and radially spaced from the first position.

25. The sliding sleeve valve of claim 22, wherein, in response to displacement of the indexing pin through the J-slot, the indexing pin is configured to release the valve stem from the valve seat and thereby permit fluid communication between the actuation chamber and an actuation passage that extends from the valve seat.

26. The sliding sleeve valve of claim 16, wherein the actuator chamber is disposed radially between an inner cylindrical surface and an outer cylindrical surface of the actuator housing.

27. The sliding sleeve valve of claim 16, wherein the actuator chamber is positioned within a wall of the actuator housing and wherein relative movement between the actuator housing and the outer housing is restricted.

28. A method for actuating a sliding sleeve valve disposed in a wellbore, comprising:

applying a predetermined fluid pressure to a central passage of an outer housing in which a sliding sleeve of the sliding sleeve valve is received, and to an actuator housing of the sliding sleeve valve wherein the actuator housing comprises a cylindrical actuator chamber that is radially offset from the central axis of the actuator housing;

communicating the fluid pressure to an actuator chamber formed in the actuator housing; and moving the sliding sleeve of the sliding sleeve valve from a first position to a second position axially spaced from the first position to provide fluid communication between the sliding sleeve valve and an environment surrounding the sliding sleeve valve in response to communicating the fluid pressure to the central passage of the outer housing and the actuator chamber.

29. The method of claim 28, further comprising rupturing a rupture disk of the sliding sleeve valve to communicate the pressure to the actuator chamber.

30. The method of claim 29, further comprising displacing an indexing sleeve and a piston through the actuator chamber in response to rupturing the rupture disk.

31. The method of claim 30, further comprising displacing an indexing pin through a J-slot formed on an outer surface of the indexing sleeve in response to the displacement of the indexing sleeve through the actuator chamber.

32. The method of claim 31, further comprising cycling the indexing pin between a plurality of positions along the J-slot of the indexing sleeve in response to pressurizing the actuator housing.

33. The method of claim 30, further comprising unseating a valve stem disposed in the actuator chamber from a valve seat formed on the actuator chamber to thereby communicate pressure from a central passage of the actuator housing to an atmospheric chamber disposed adjacent to the sliding sleeve.

34. The method of claim 28, wherein the actuator chamber is positioned within a wall of the actuator housing and wherein relative movement between the actuator housing and the outer housing is restricted.

* * * * *